US011415364B2

(12) United States Patent
Hong

(10) Patent No.: US 11,415,364 B2
(45) Date of Patent: Aug. 16, 2022

(54) REFRIGERATOR

(71) Applicant: LG ELECTRONICS INC., Seoul (KR)

(72) Inventor: EuDdeum Hong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 229 days.

(21) Appl. No.: 16/582,647

(22) Filed: Sep. 25, 2019

(65) Prior Publication Data

US 2021/0010744 A1 Jan. 14, 2021

(30) Foreign Application Priority Data

Jul. 12, 2019 (KR) ..... 10-2019-0084444

(51) Int. Cl.

| | |
|---|---|
| ***F25D 25/02*** | (2006.01) |
| ***F25D 23/02*** | (2006.01) |
| ***F25D 25/00*** | (2006.01) |
| ***A47B 88/90*** | (2017.01) |

(52) U.S. Cl.

CPC ..... *F25D 25/005* (2013.01); *A47B 88/90* (2017.01); *F25D 25/025* (2013.01); *A47B 2088/901* (2017.01)

(58) Field of Classification Search

CPC ..... F25D 25/005; F25D 25/025; A47B 88/90; A47B 2088/901

See application file for complete search history.

(56) References Cited

U.S. PATENT DOCUMENTS

| | | | |
|---|---|---|---|
| 658,999 | A | 10/1900 | Scannel |
| 1,067,404 | A | 7/1913 | Callaghan |
| 2,072,244 | A | 3/1937 | Coursen |
| 2,679,658 | A | 6/1954 | McCormick |
| 2,731,318 | A | 1/1956 | Hoff |
| 4,545,628 | A | 10/1985 | Richey |

(Continued)

FOREIGN PATENT DOCUMENTS

| | | |
|---|---|---|
| CN | 100417900 | 9/2008 |
| CN | 101981397 | 2/2011 |

(Continued)

OTHER PUBLICATIONS

European Communication dated Feb. 8, 2021 issued in Application No. 19199627.1.

(Continued)

*Primary Examiner* — Kimberley S Wright

(74) *Attorney, Agent, or Firm* — KED & Associates LLP

(57) ABSTRACT

A refrigerator includes: a cabinet having a storage chamber provided therein and an open front; a cooling device cooling the storage chamber; a drawer including a front panel and a storage bin, the front panel allowing an open front portion of the storage chamber to be opened and closed and the storage bin being provided in rear of the front panel and storing a container or food therein; an inner first cover provided at the storage bin so as to cover a rear end portion of an inner space of the storage bin; and a raising/lowering lift device provided at a side of the storage chamber to fold downward and unfold upward for vertical movement of a container; and a second covering provided to cover a gap between the raising/lowering device and the inner cover.

20 Claims, 24 Drawing Sheets

(56) References Cited

U.S. PATENT DOCUMENTS 5,253,488 A 10/1993 Kim et al.
6,044,606 A 4/2000 Hamar
6,109,774 A 8/2000 Holmes et al.
6,371,584 B1 4/2002 Alreck
6,722,749 B1 4/2004 Pagac
7,600,829 B2 * 10/2009 Oh ..... A47B 51/00 312/404
7,600,830 B2 * 10/2009 Oh ..... A47B 67/04 312/404
7,600,833 B2 * 10/2009 Oh ..... F25D 25/025 312/404
7,690,586 B2 4/2010 Kang
8,282,177 B1 10/2012 Rotter
8,360,539 B2 1/2013 Brown et al.
8,376,481 B2 2/2013 Lee
8,497,644 B2 7/2013 Eom et al.
8,668,289 B2 3/2014 Lee et al.
8,794,722 B2 8/2014 Nuss et al.
8,844,110 B2 9/2014 Rotter
8,864,249 B2 10/2014 Nam et al.
9,107,494 B2 8/2015 Scheuring et al.
9,377,238 B2 6/2016 Hall et al.
9,523,533 B2 12/2016 Nam et al.
9,982,937 B2 5/2018 Tierney et al.
10,234,195 B2 3/2019 Yasaka et al.
10,465,970 B1 * 11/2019 Kang ..... F25D 25/025
10,598,428 B2 * 3/2020 Kim ..... F25D 23/028
10,690,401 B2 * 6/2020 Yang ..... F25D 25/025
10,712,083 B1 7/2020 Choi
10,767,920 B1 * 9/2020 Choi ..... F25D 23/067
10,786,080 B1 9/2020 Stravitz et al.
10,876,788 B2 12/2020 Choi
10,932,568 B2 3/2021 Subrahmanya et al.
10,939,758 B2 * 3/2021 Kim ..... F25D 23/021
11,033,104 B2 6/2021 Kim
11,047,619 B2 6/2021 Choi
11,131,500 B2 9/2021 Kim
2003/0201700 A1 10/2003 Cho
2004/0031705 A1 2/2004 Detemple, II et al.
2004/0046488 A1 3/2004 Hogan
2004/0056573 A1 3/2004 Chae
2006/0042306 A1 3/2006 Choi et al.
2006/0087207 A1 * 4/2006 Oh ..... A47B 51/00 312/402
2006/0087208 A1 4/2006 Oh et al.
2006/0207283 A1 9/2006 Kim et al.
2006/0248916 A1 11/2006 Kim et al.
2006/0250062 A1 11/2006 Janda et al.
2007/0262686 A1 11/2007 Ji
2008/0018215 A1 * 1/2008 Carden ..... F25D 25/025 312/404
2009/0045713 A1 2/2009 Kunkle et al.
2009/0160298 A1 6/2009 Chen et al.
2009/0167131 A1 * 7/2009 Oh ..... F25D 25/025 312/405
2009/0277210 A1 11/2009 Eveland et al.
2010/0192621 A1 8/2010 Kim
2010/0236279 A1 9/2010 Eom et al.
2010/0239795 A1 9/2010 Gat
2010/0283365 A1 11/2010 Chen
2011/0005264 A1 1/2011 Lee et al.
2011/0006656 A1 1/2011 Nam et al.
2011/0050065 A1 3/2011 Lee et al.
2011/0050066 A1 3/2011 Lee et al.
2011/0146333 A1 6/2011 Koo et al.
2011/0162402 A1 7/2011 Park
2011/0181163 A1 7/2011 Han et al.
2011/0210655 A1 9/2011 Brown et al.
2012/0091872 A1 4/2012 Matthes et al.
2012/0125035 A1 5/2012 Chellappan et al.
2012/0306338 A1 12/2012 Nagahata et al.
2013/0055543 A1 3/2013 Rotter
2013/0129267 A1 5/2013 Chen
2013/0145972 A1 6/2013 Knox et al.
2013/0264928 A1 10/2013 Hong et al.
2013/0270986 A1 10/2013 Min et al.
2013/0270987 A1 10/2013 Kelly
2013/0270989 A1 10/2013 Park et al.
2014/0191646 A1 7/2014 Nuss et al.
2014/0265783 A1 9/2014 Hauer et al.
2014/0265797 A1 9/2014 Scheuring et al.
2014/0265806 A1 * 9/2014 Hall ..... F25D 25/025 312/408
2014/0319990 A1 10/2014 Gephart et al.
2015/0059398 A1 3/2015 Yoo et al.
2015/0059399 A1 3/2015 Hwang et al.
2015/0069899 A1 3/2015 Han et al.
2015/0184918 A1 7/2015 Klingshirn et al.
2016/0146533 A1 5/2016 Jung
2016/0153704 A1 6/2016 Burke et al.
2016/0178274 A1 6/2016 Shin
2016/0265816 A1 9/2016 Gillette et al.
2016/0305705 A1 10/2016 Dubina et al.
2016/0320118 A1 11/2016 Millett
2016/0370063 A1 12/2016 Yang
2017/0024946 A1 1/2017 Hashemi et al.
2017/0051967 A1 2/2017 Tierney et al.
2017/0122651 A1 5/2017 Cizik et al.
2017/0227279 A1 8/2017 Yang et al.
2017/0336129 A1 11/2017 Cunningham
2017/0362864 A1 12/2017 Fazi et al.
2018/0128540 A1 5/2018 Yasaka et al.
2018/0283771 A1 10/2018 Shin et al.
2018/0291669 A1 10/2018 Kim et al.
2018/0356148 A1 12/2018 Fei et al.
2019/0219324 A1 7/2019 Kang
2019/0242640 A1 8/2019 Minoru et al.
2019/0292831 A1 * 9/2019 Choi ..... F25D 23/028
2019/0293341 A1 * 9/2019 Yeom ..... F25D 23/069
2019/0323763 A1 * 10/2019 Kang ..... F25D 25/025
2019/0346199 A1 11/2019 Choi
2019/0390895 A1 12/2019 Choi
2020/0011593 A1 1/2020 Ji
2020/0069056 A1 3/2020 Kim
2020/0072533 A1 3/2020 Cho
2020/0072540 A1 3/2020 Kim
2020/0072542 A1 3/2020 Kim
2021/0003337 A1 1/2021 Voltarelli et al.
2021/0259416 A1 8/2021 Kim

FOREIGN PATENT DOCUMENTS

CN 102226626 10/2011
CN 202254607 5/2012
CN 202970226 6/2013
CN 204902419 12/2015
CN 107388718 11/2017
CN 108645104 10/2018
CN 109028726 12/2018
CN 208640001 3/2019
CN 109690213 4/2019
CN 208736030 4/2019
CN 109838961 6/2019
CN 109990557 7/2019
CN 110873500 3/2020
DE 29620152 4/1997
DE 10 2005 016 418 11/2005
EP 1 724 540 11/2006
EP 2 299 215 3/2011
EP 2752632 A2 * 7/2014 ..... F25D 23/069
EP 3 023 721 5/2016
EP 3 505 854 7/2019
EP 3 546 862 10/2019
EP 3 617 630 3/2020
GB 2108564 5/1983
JP H04-138337 12/1992
JP H07-275049 10/1995
JP H08-303944 11/1996
JP 2001-280824 10/2001
JP 2002-264943 9/2002
KR 10-2006-0025806 3/2006
KR 10-2006-0027592 3/2006
KR 10-2006-0053420 5/2006

(56) References Cited

FOREIGN PATENT DOCUMENTS

| | | |
|---|---|---|
| KR | 10-2007-0075671 | 7/2007 |
| KR | 10-2008-0101335 | 11/2008 |
| KR | 10-2009-0027111 | 3/2009 |
| KR | 10-2009-0027112 | 3/2009 |
| KR | 10-2009-0102576 | 9/2009 |
| KR | 10-2009-0102577 | 9/2009 |
| KR | 10-0921380 | 10/2009 |
| KR | 10-2009-0114265 | 11/2009 |
| KR | 10-2010-0012544 | 2/2010 |
| KR | 10-0946784 | 3/2010 |
| KR | 10-2010-0078916 | 7/2010 |
| KR | 10-2011-0015331 | 2/2011 |
| KR | 20-0460442 | 6/2012 |
| KR | 10-2013-0071919 | 7/2013 |
| KR | 10-2014-0037474 | 3/2014 |
| KR | 10-2018-0138083 | 12/2018 |
| KR | 10-2018-0138085 | 12/2018 |
| KR | 10-2019-0081331 | 7/2019 |
| WO | 92/14522 | 9/1992 |
| WO | WO 03/016661 | 2/2003 |
| WO | WO 2018/051963 | 3/2018 |
| WO | WO 2019/242234 | 12/2019 |

OTHER PUBLICATIONS

Chinese Office Action dated Sep. 3, 2021 issued in CN Application No. 201910905106.9.
European Office Action dated Sep. 30, 2020 issued in EP Application No. 19199556.2.
United States Office Action dated Mar. 4, 2020 issued in U.S. Appl. No. 16/582,712.
United States Office Action dated Mar. 9, 2020 issued in U.S. Appl. No. 16/582,810.
European Search Report dated Mar. 23, 2020 issued in EP Application No. 19199602.4.
United States Office Action dated Nov. 19, 2020 issued in U.S. Appl. No. 16/582,831.
European Search Report dated Aug. 14, 2020 issued in EP Application No. 19199647.9.
European Search Report dated Apr. 1, 2020 issued in EP Application No. 19199637.0.
European Search Report dated Mar. 12, 2020 issued in EP Application No. 19199586.9.
European Search Report dated Mar. 17, 2020 issued in EP Application No. 19199553.9.
European Search Report dated Mar. 20, 2020 issued in EP Application No. 19199569.5.
European Search Report dated Mar. 30, 2020 issued in EP Application No. 19199556.2.
European Search Report dated Apr. 3, 2020 issued in EP Application No. 19199625.5.
European Search Report dated Apr. 6, 2020 issued in EP Application No. 19199629.7.
European Search Report dated Apr. 6, 2020 issued in EP Application No. 19199587.7.
European Search Report dated Apr. 7, 2020 issued in EP Application No. 19199607.3.
Chinese Office Action dated Aug. 20, 2021 issued in CN Application No. 201910857469.X.
Chinese Office Action dated Aug. 25, 2021 issued in CN Application No. 201910911807.3.
Chinese Office Action dated Sep. 2, 2021 issued in CN Application No. 201910871084.9.
Chinese Office Action dated Sep. 17, 2021 issued in CN Application No. 201910905094.X.
United States Office Action dated Jan. 31, 2022 issued in co-pending related U.S. Appl. No. 16/582,756.
United States Office Action dated Feb. 2, 2022 issued in co-pending related U.S. Appl. No. 16/582,605.
European Office Action dated Sep. 1, 2021 issued in EP Application No. 19199607.3.
United States Office Action dated Oct. 6, 2021 issued in co-pending related U.S. Appl. No. 16/583,726.
United States Office Action dated Oct. 6, 2021 issued in co-pending related U.S. Appl. No. 16/582,668.
United States Office Action dated Oct. 15, 2021 issued in co-pending related U.S. Appl. No. 16/582,755.
United States Notice of Allowance dated Feb. 23, 2022 issued in co-pending related U.S. Appl. No. 16/582,518.
United States Notice of Allowance dated Feb. 23, 2022 issued in co-pending related U.S. Appl. No. 16/585,284.
Chinese Office Action dated Aug. 24, 2021 issued in CN Application No. 201910911796.9.
Chinese Office Action dated Sep. 8, 2021 issued in CN Application No. 201910857458.1.
Chinese Office Action dated Sep. 14, 2021 issued in CN Application No. 201910905166.0.
GE (Refrigerator Freezer Door Pops Open, https://products.geapplicances.com/appliance/gea-support-search-content?content1d=16979) (Year: 2015).
United States Office Action dated Apr. 11, 2022 issued in co-pending related U.S. Appl. No. 16/585,301.
Chinese Office Action dated May 16, 2022 issued in CN Application No. 201910905106.9.

* cited by examiner

REFRIGERATOR

CROSS-REFERENCE TO RELATED APPLICATION(S)

The present application claims priority to Korean Patent Application No. 10-2019-0084444, filed in Korea on Jul. 12, 2019, the entire contents of which is incorporated herein for all purposes by this reference.

BACKGROUND

1. Field

The present disclosure generally relates to a refrigerator.

2. Background

A refrigerator is an appliance that includes a cabinet defining an interior storage chamber that is maintained at a relatively cool temperature. For example, the refrigerator may generate cold air to cool the storage chamber by circulation of a refrigerant according to a refrigeration cycle.

The refrigerator may include various types of mechanisms that provide access to the storage chamber via an opening in the cabinet and seal the opening. For example, the refrigerator may include a swinging door and/or a sliding drawer. A hybrid-type refrigerator may include both a door and a drawer. The hybrid-type refrigerator may include, for example, at least one swinging door positioned at an upper portion of the cabinet and a drawer positioned at a lower portion of the cabinet.

The drawer may include a front panel and a storage bin. The front panel may form a portion of a front surface of the refrigerator and may provide a handling surface to receive a user-applied force to slide the drawer in or out of an interior of the cabinet. The storage bin may be provided at a rear of the front panel to be selectively inserted into or removed from the interior of the cabinet based on the user-applied force to the front panel. Accessing the drawer provided at the lower part of the cabinet to insert or remove stored items may be inconvenient to a user.

Various structures have been developed to provide a drawer that can be moved upward and downward. For example, U.S. Pat. No. 9,377,238 describes a refrigerator include having a lifting mechanism in a storage chamber to move a bin upward or downward, and Korean Patent Application Publication No. 10-2019-0081331 discloses a refrigerator include having a raising/lowering device. However, these lifting mechanisms for moving a bin upward or downward may have a structure that is positioned outside or exposed to the outside of the bin, so the lifting mechanism may have an undesirable appearance and may have safety concerns.

The above references are incorporated by reference herein where appropriate for appropriate teachings of additional or alternative details, features and/or technical background.

BRIEF DESCRIPTION OF THE DRAWINGS

Embodiments will be described in detail with reference to the following drawings in which like reference numerals refer to like elements, and wherein.

DETAILED DESCRIPTION

Figure 1:
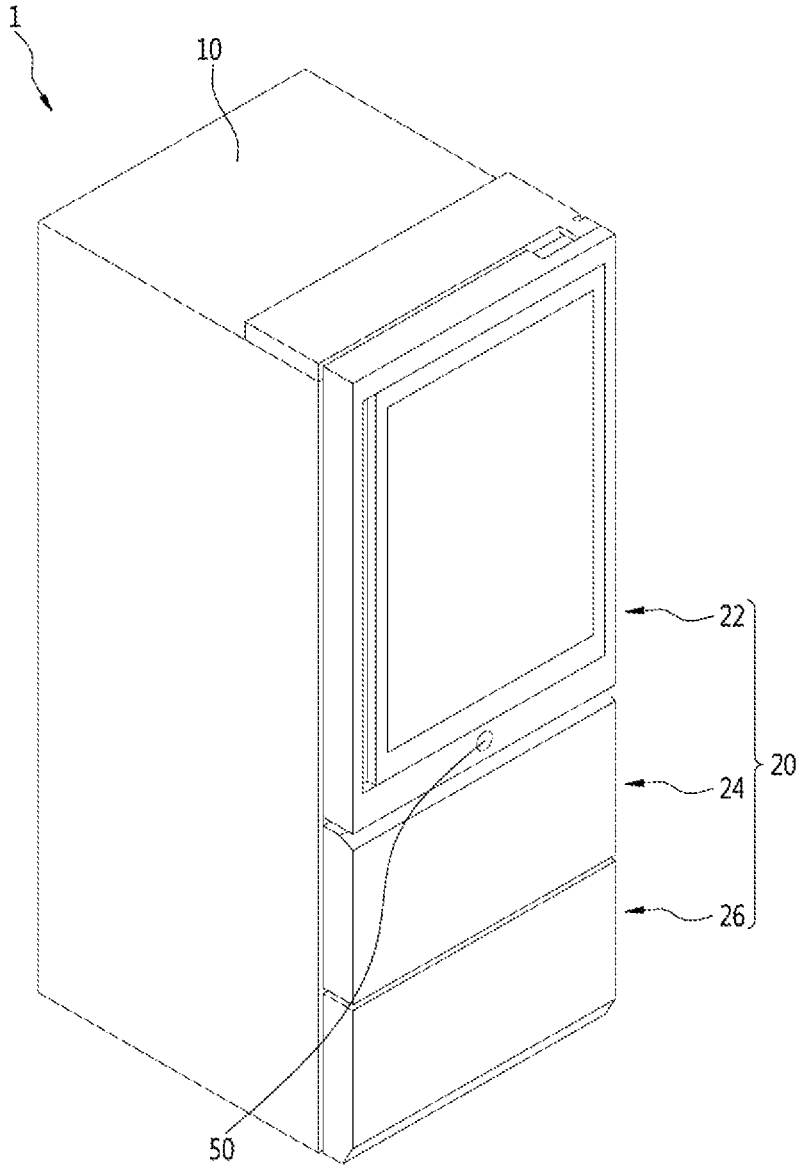
FIG. 1 is a perspective view illustrating configuration of an exemplary the refrigerator according to an embodiment of the present disclosure.
Figure 2:
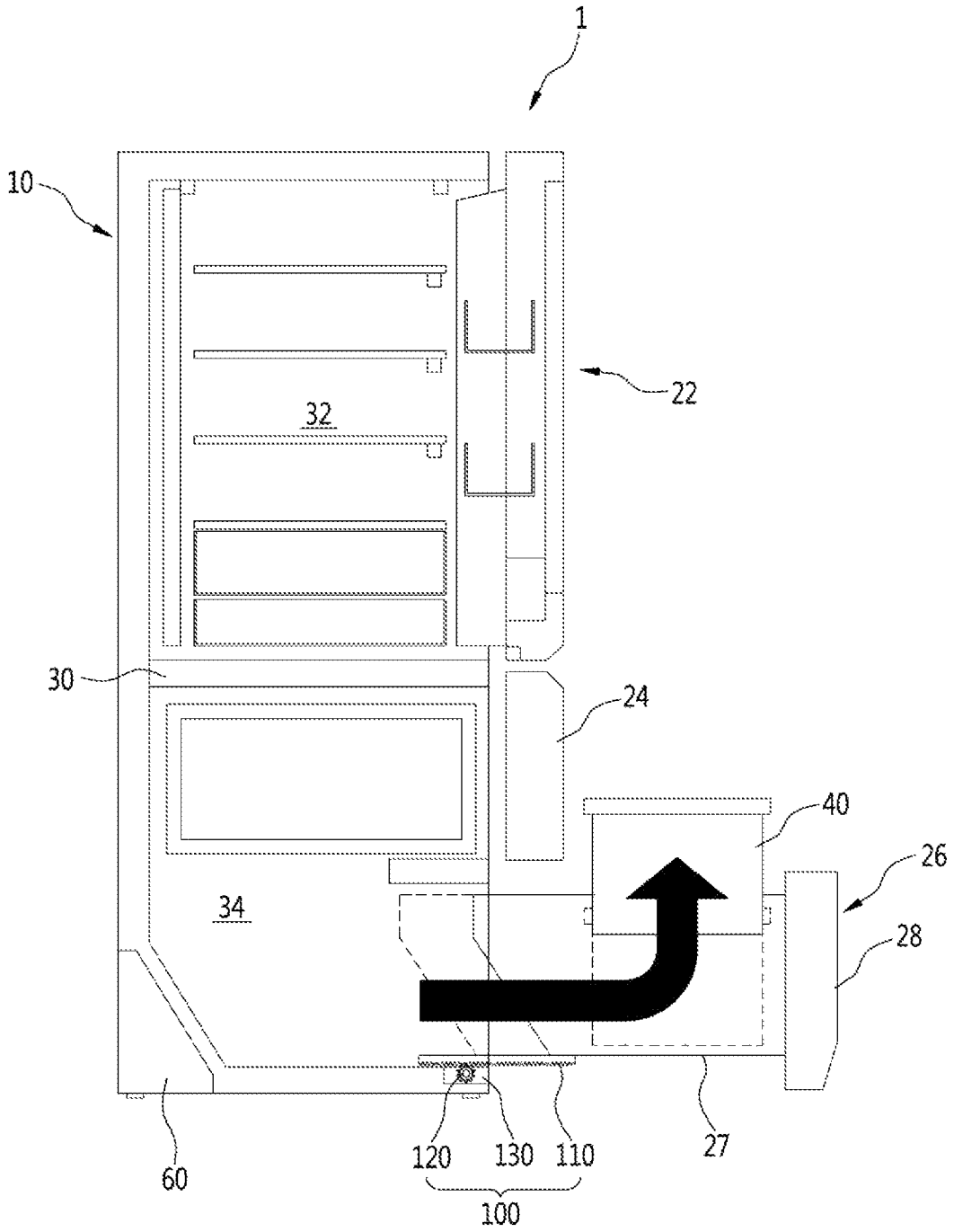
FIG. 2 is a sectional view of the refrigerator illustrating a state of a container moved upward by a raising/lowering device according to an embodiment of the present disclosure.

As illustrated in FIGS. 1 and 2, the refrigerator 1 may be formed to have a particular volume as a hexahedron and may include a storage chamber for storing food or other items therein. For example, as an appearance of the refrigerator 1, the refrigerator may include a cabinet 10 having a space including the storage chamber therein and an open surface thereof (e.g., a front thereof); and at least one door 20 covering the open surface (the front) of the cabinet 10. A cooling device may be included in the refrigerator 1 to cool the storage chamber. Referring to FIG. 1, the cabinet 10 of the refrigerator 1 may be configured such that the front thereof may be open, and the door 20 covers the front of the cabinet 10.

An inner part of the cabinet 10 may be partitioned into multiple spaces. For example, a space of the storage chamber provided in the cabinet 10 may be divided by at least one inner wall 30. For example, the space may be divided into upper and lower spaces by the parallel inner wall 30. For example, the cabinet 10 may include an upper space 32 on an upper side thereof and a lower space 34 provided on a lower side thereof relative to the inner wall 30. For example, the upper space 32 may be used as a refrigerating compartment and the lower space 34 may be used as a freezer compartment.

In other examples, a role of the upper space 32 and a role of the lower space 34 may be exchanged, both of the upper space 32 and the lower space 34 may be used as a refrigerating compartment, or both of the upper space 32 and the lower space 34 may be used as a freezer. For example, the upper space 32 and the lower space 34 may be designed to be used as a one of a freezer or a refrigerating compartment or for other purposes, when required.

The door 20 may be provided as a swinging type door or a drawer moving forward and backward. In the present disclosure, the upper space 32 may include a swinging door 22, and the lower space 34 may include drawers 24 and 26.

In addition, the lower space 34 may be divided into two inner spaces, and the two drawers 24 and 26 may be arranged horizontally in the two spaces, respectively. For example, an upper space may be covered by an upper drawer 24, a lower space may be covered by a lower drawer 26. In other configurations, the number of the doors may be variously changed depending on an inner space of the cabinet 10, and the doors may be provided entirely as the swinging doors 22 or entirely as the drawers 24 and 26.

The drawers 24 and 26 may be configured to be automatically moved forward or backward by an opening/closing device (or opening/closing module) 100. In addition, such drawers 24 and 26 may include the raising/lowering device (or lift module) 200, which will be described hereinbelow, such that the container 40 provided therein may be automatically moved upward and downward.

Furthermore, a portion or all of the drawers 24 and 26 may be configured to automatically move forward and backward. For example, all of the upper drawer 24 and the lower drawer 26 may be configured to automatically move forward and backward, or the upper drawer 24 may be configured to manually move forward and backward and the lower drawer 26 may be configured to automatically move forward and backward.

In the present disclosure, the upper drawer 24 may be configured to manually move forward and backward, and only the lower drawer 26 may be automatically moved forward and backward by the opening/closing device 100. The container 40 may be configured to be automatically moved upward and downward by the raising/lowering device 200, which will be described hereinbelow.

The opening/closing device 100 may be provided to have a rack-pinion structure that applies a force to move the drawer 26 forward and backward (e.g., to opposite sides of FIG. 2). For example, a rack 110 may be provided on a lower surface of the lower drawer 26 and the pinion 120 meshing with the rack 110 by gear engagement may be rotatably provided in a bottom surface of the refrigerator 1. In addition, a motor 130 may be provided on a bottom surface of the refrigerator 1 and may supply a rotational force to the pinion 120. For example, when the motor 130 generates the rotational force (e.g., by using power supplied from an external source), the pinion 120 may be rotated clockwise or counterclockwise by the rotational force of the motor 130. For example, the lower drawer 26 combined with the rack 110 moves forward and backward (e.g., to the opposite sides of FIG. 2).

The rack 110 may be configured to be a double rack. For example, to allow the lower drawer 26 to be sufficiently opened to the outside, the rack 110 may be configured as a double rack having at least two racks, such as a first rack that moves the lower drawer 26 a first horizontal distance, and a second rack that moves the lower drawer 26 a second horizontal distance.

Meanwhile, the refrigerator 1 may include a button 50 to control the lower drawer 26 such that the lower drawer 26 may be automatically opened or closed. For example, as illustrated in FIG. 1, the button 50 may be provided on a front surface of a lower end of the swinging door 22 in the refrigerator 1, and the lower drawer 26 may be configured to be opened or closed by a user pressing the button. In other examples, the button 50 may be provided on a front surface of the lower drawer 26 or may be provided on various other locations, such as a front surface or side surface of the refrigerator 1.

The drawer 26 may include a storage bin 27 having a containing space or receiving the container 40 therein and a front panel 28 provided at a front (a right side of FIG. 2) of the storage bin 27 to be integrated therewith so as to constitute an outer front surface of the drawer 26. In addition, the refrigerator 1 may include a machine bin 60 provided at a lower rear side thereof. Various components, such as a compressor and a condenser performing a refrigeration cycle, may be arranged in the machine bin 60.

Figure 3:
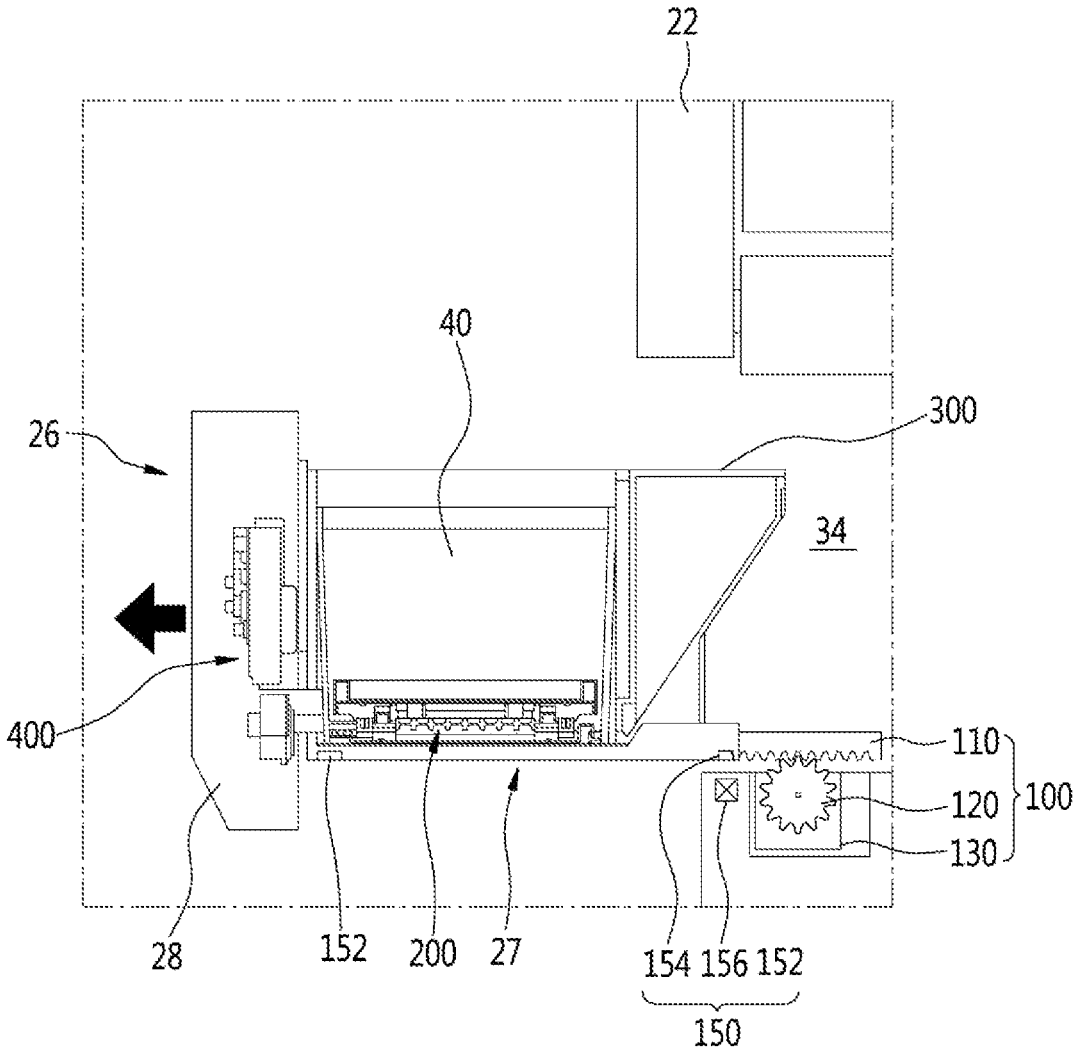
FIG. 3 is a partial sectional view illustrating a state of a lower drawer moved forward according to an embodiment of the present disclosure.
Figure 4:
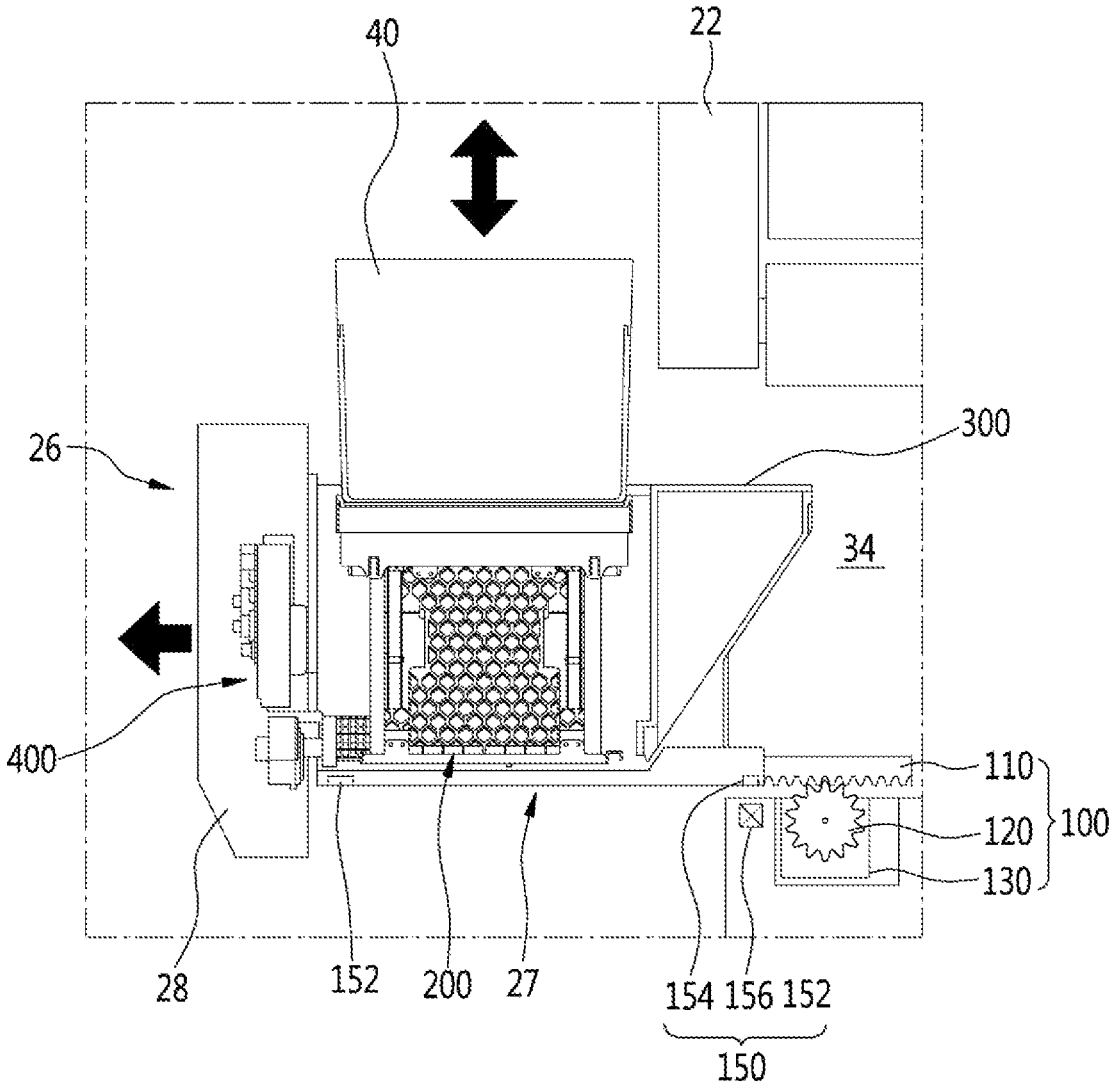
FIG. 4 is a partial sectional view illustrating a state of the container moved upward by the raising/lowering device according to an embodiment of the present disclosure.

In FIGS. 3 and 4, the lower drawer 26 of the drawers 24 and 26 are shown as being substantially opened forward (e.g., to a left side of FIG. 3). For example, as illustrated in FIG. 3, the lower drawer 26 may be completely opened forward but the raising/lowering device 200 does not operate yet, and as illustrated in FIG. 4, after the lower drawer 26 has been completely opened forward, the container 40 may be moved upward by the raising/lowering device 200.

As illustrated in these drawings, the lower drawer 26 may be moved forward (to a left side of FIGS. 3 and 4) by a forward moving control by the button 50. For example, the forward movement of the lower drawer 26 may be performed by the opening/closing device 100. Such a lower drawer 26 may be configured to not be opened and closed by a manual manipulation of a user, but instead, the lower drawer 26 may be automatically opened and closed by a manipulation of a user pressing the button 50. For example, when a user presses the button 50, the rotational force may be generated by the motor 130, and the pinion 120 may be rotated counterclockwise by the rotational force.

For example, when the pinion 120 is rotated counterclockwise, the rack 110 meshing with the pinion 120 may be moved to the left, and an entirety of the lower drawer 26 to which the rack 110 is fixed may move to the left and may be open. In some examples, a distance which the lower drawer 26 moves to be open to the left may be a length allowing the container 40 received into the storage bin 27 to be completely exposed to the outside from the front surface of the refrigerator 1. For example, the lower drawer 26 may be required to be sufficiently opened such that a user takes out the container 40, or takes out or stores food in the container 40.

In addition, the container 40 may be moved upward by the raising/lowering device 200 provided at a lower side of the container 40. Even in this case, the lower drawer 26 may be required to be sufficiently opened such that the container 40 does not hit the front surface of the refrigerator 1, for example, a lower end of a front surface of the upper drawer 24. For example, to allow the lower drawer 26 to be sufficiently removed forward, the structure having the pinion 120 and the rack 110 may include the double rack structure.

Whether the lower drawer 26 may be sufficiently open may be determined by an open/close detecting mechanism (or sensor) 150. The open/close detecting mechanism 150 detects whether the lower drawer 26 may be sufficiently open to the outside (the left side of FIG. 3), and may include permanent magnets 152 and 154, and a detection sensor 156.

The permanent magnets 152 and 154 may be fixed to a left end (a front end of the lower surface of the lower drawer) of the lower surface of the lower drawer 26 and a right end thereof (a rear end thereof), respectively, and the detection sensor 156 may be fixed to a front end part of the bottom surface of the refrigerator 1. For example, as illustrated in FIG. 3, the permanent magnets 152 and 154 may include a front end magnet 152 provided at the left end (the front end) of the lower surface of the lower drawer 26 and a rear end magnet 154 provided at the right end (the rear end) of the lower drawer 26. For example, when the front end magnet 152 is brought close to (e.g., within a threshold distance of) the detection sensor 156, the lower drawer 26 may be recognized to be closed and when the rear end magnet 154 may be brought close to (e.g., within a threshold distance of) the detection sensor 156, the lower drawer 26 may be recognized to be opened. The detection sensor 156 may be various sensors, such as a hall sensor or a lead switch.

The components of the open/close detecting mechanism 150 may be installed at other positions than the above-described positions. For example, the permanent magnets 152 and 154 may be installed at the bottom surface of the refrigerator 1 and the detection sensor 156 may be installed at the lower drawer 26.

The container 40 of a shape of a rectangular container having an open upper part may be received in an inner space of the storage bin 27 and the container 40 may be configured to be moved upward and downward by the raising/lowering device 200. For example, the raising/lowering device 200 may be configured to be installed under the container 40 so as to support the container 40.

A rear side of the inner space of the storage bin 27 (e.g., right sides of FIGS. 3 and 4) may be covered by an inner cover 300. As illustrated in FIGS. 3 and 4, the inner cover 300 may be installed to have a section of an "L" shape as a whole and may cover the remaining rear end space of the inner space of the storage bin 27 except for a space corresponding to an occupying space of the container 40 in the inner space thereof. For example, the rear end space in the storage bin 27 may be covered by the inner cover 300, whereby a neat appearance may be provided to a user and a hand of the user may be prevented from being trapped therein.

As illustrated in FIG. 3, when the forward movement of the lower drawer 26 may be completed, then the raising/lowering device 200 operates and the container 40 may be moved upward. For example, the raising/lowering device 200 positioned under the container 40 operates and the container 40 may be lifted to an upper side of the storage bin 27. For example, in FIG. 4, a state of the container 40 completely moved upward by the raising/lowering device may be illustrated.

A driving device 400 may be provided in the front panel 28 of the lower drawer 26 and controls operation of the raising/lowering device 200. For example, a vertical height of the raising/lowering device 200 may be changed such that a distance between an upper surface and a lower surface of the raising/lowering device increases or decreases. For example, the raising/lowering device 200 moves the container 40 at an upper side thereof upward and downward, and the operation of the raising/lowering device 200 may be controlled by the driving device 400.

The raising/lowering device 200 may be configured to be folded or unfolded in an upper end and lower end thereof, and when the raising/lowering device may be not used, volume thereof may be minimized, so the raising/lowering device 200 may be received in the storage bin 27. For example, the raising/lowering device 200 may be configured to have a scissor type link structure in which the height of the raising/lowering device 200 may be minimized during the folding of the raising/lowering device 200 and the height of the raising/lowering device 200 may be maximized during the unfolding of the raising/lowering device 200. When a folded state of the raising/lowering device 200 may be detected while the lower drawer 26 may be completely removed and the raising/lowering device 200 may be also completely lowered, the driving device 400 may operate and allow the raising/lowering device 200 to unfold.

In some examples, an additional raising/lowering detection mechanism (or raising/lowering sensor) may be provided in the front panel 28, in the driving device 400, or in an area adjacent thereto and detects whether the raising/lowering device 200 may be folded or unfolded. In other examples, due to the upward or downward moving position of the container 40 detected, the folding or unfolding of the raising/lowering device 200 may also be determined.

Figure 5:
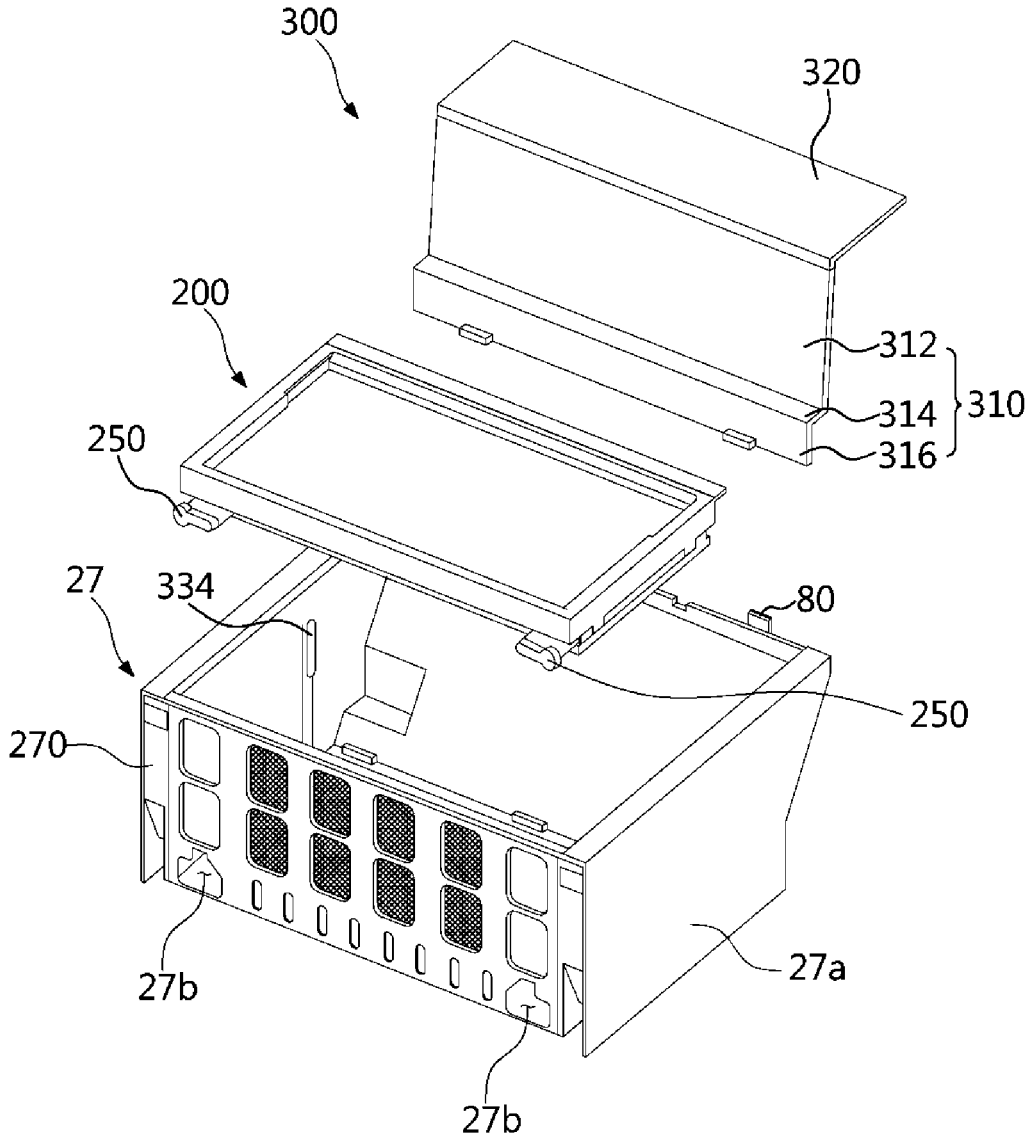
FIG. 5 is an exploded perspective view illustrating components of a storage bin of the lower drawer according to an embodiment of the present disclosure.
Figure 6:
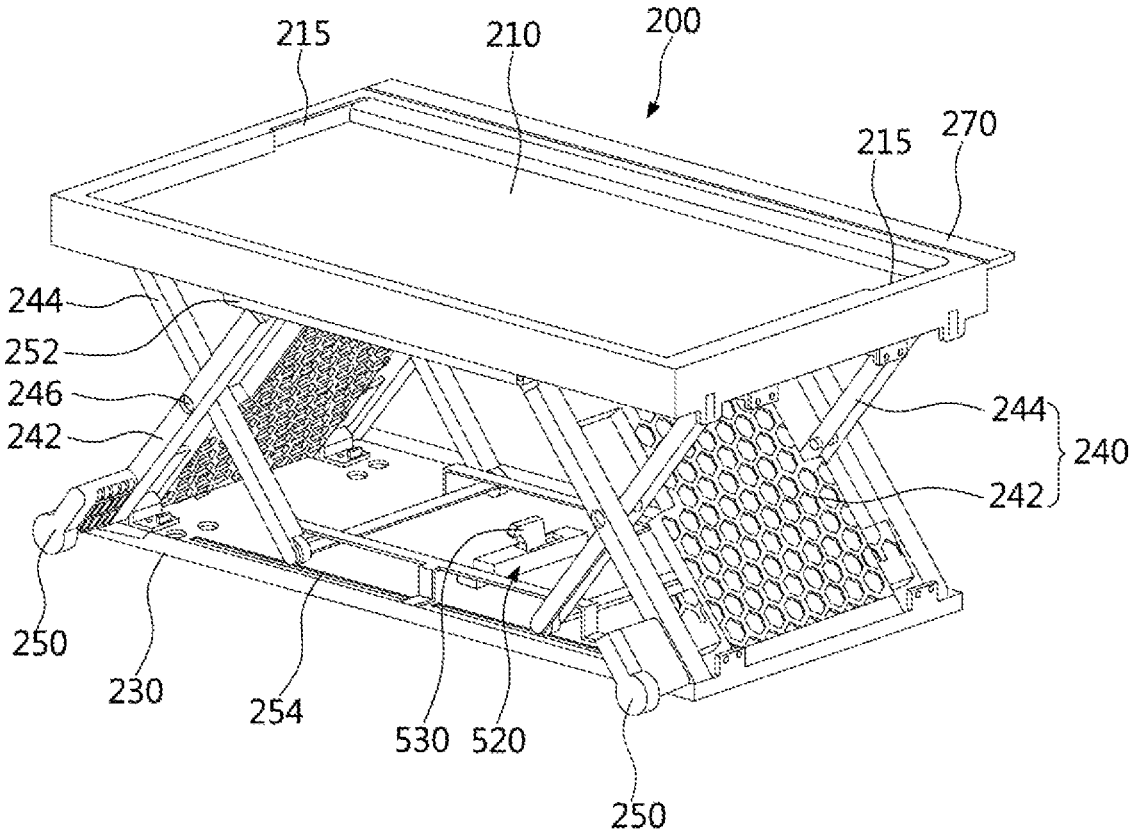
FIG. 6 is a perspective view illustrating configuration of the raising/lowering device according to an embodiment of the present disclosure.
Figure 7:
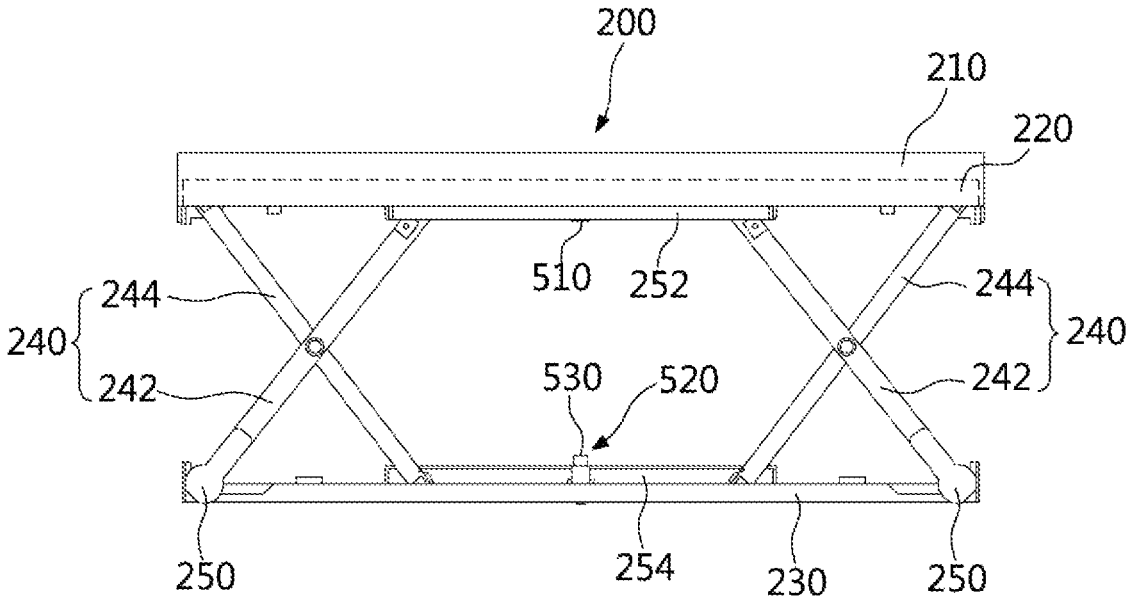
FIG. 7 is a front view illustrating the configuration of the raising/lowering device according to an embodiment of the present disclosure.
Figure 8:
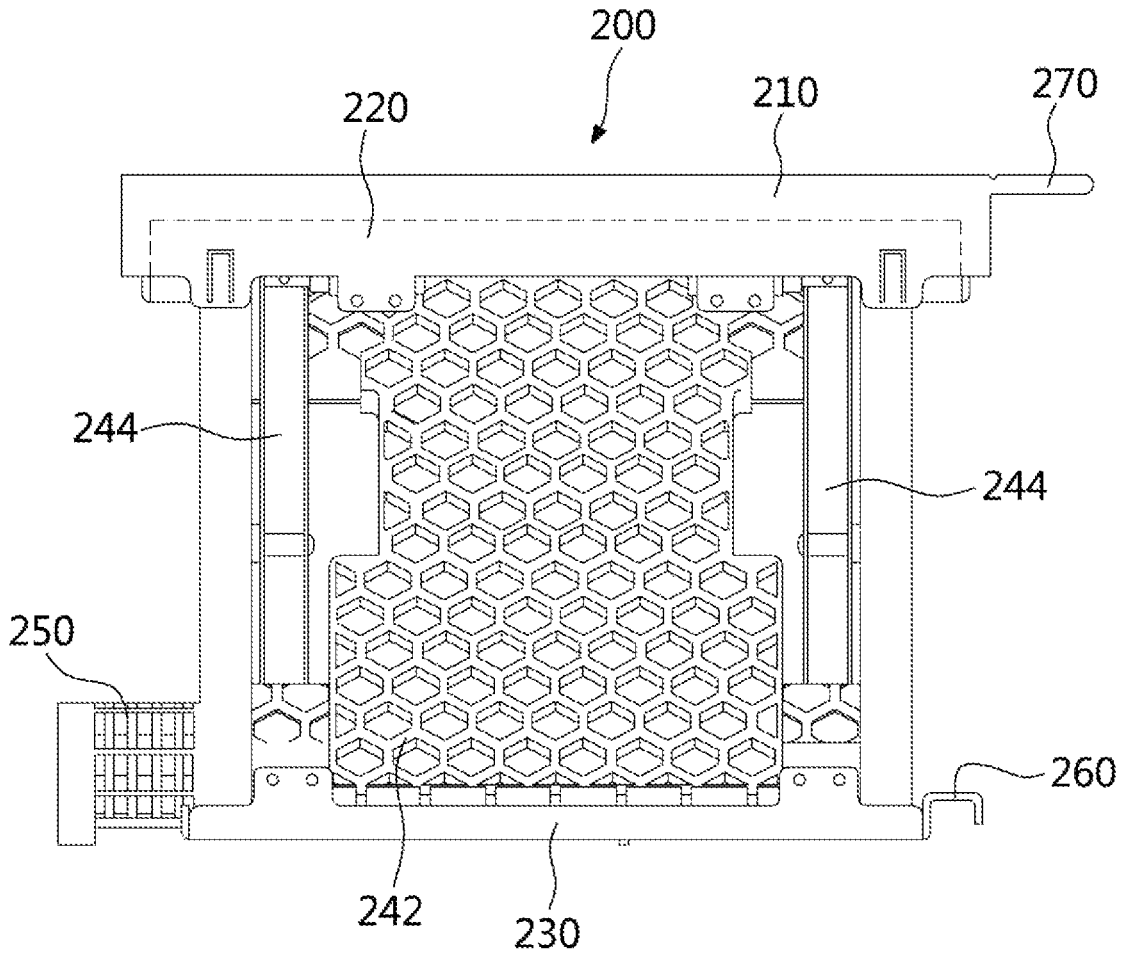
FIG. 8 is a right side view illustrating the configuration of the raising/lowering device according to an embodiment of the present disclosure.
Figure 9:
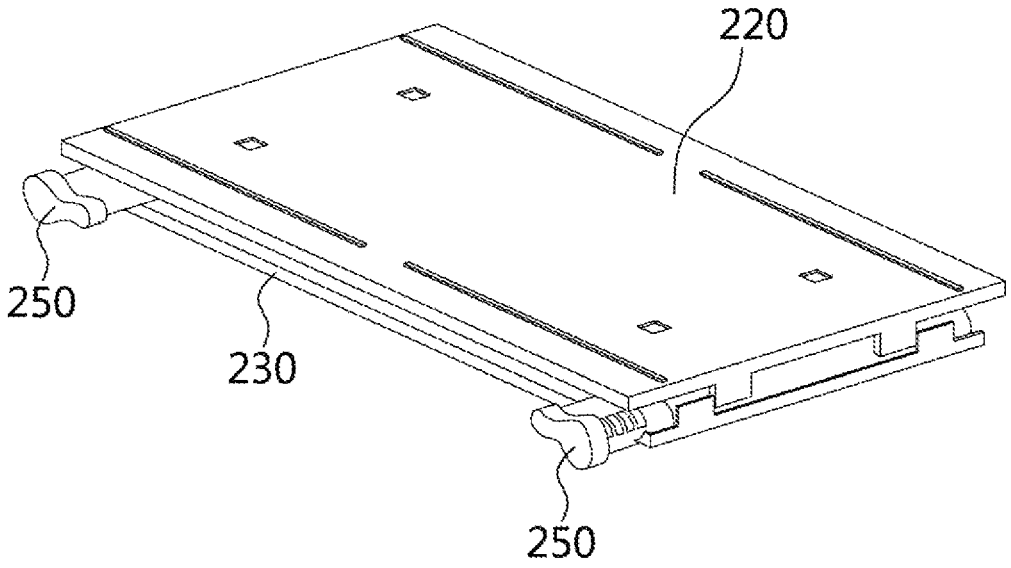
FIG. 9 is a perspective view illustrating configuration of a state of the raising/lowering device from which a support plate is removed according to an embodiment of the present disclosure.

In FIG. 5, an exploded perspective view of components provided in the storage bin 27 may be illustrated. As illustrated in FIG. 5, the storage bin 27 may be configured to have the containing space of a particular size therein so as to form an outer surface thereof. The storage bin 27 may include the raising/lowering device 200 therein such that the container 40 or food may be moved upward and downward.

In addition, the inner cover 300 may be provided in the storage bin 27 so as to cover the rear end part of the inner part of the storage bin 27 and to partition the inner space of the storage bin 27. The storage bin 27 may be formed of plastic materials by injection molding to have an entire shape thereof. The storage bin 27 may have a shape of a basket having an open upper surface to have a space therein to allow food to be stored. A rear surface of the storage bin 27 may be configured to be an inclined surface and the storage bin 27 may be prevented from being interfered with by the machine bin 60 provided at the lower rear side of the refrigerator 1.

An outer side plate 27*a* may be provided on each of opposite surfaces of outer sides of the storage bin 27. The outer side plate 27*a* may be installed on each of the opposite surfaces of the storage bin 27 to constitute outer surfaces thereof. Furthermore, the outer side plate 27*a* also functions such that components such as a door frame mounted to each of opposite sides of a drawer body 38 and the rack 110 constituting the opening/closing device 100 may be not exposed to the outside.

The inner cover (or first cover) 300 may be provided to divide the inner part of the storage bin 27 into a front space and a rear space. For example, the inner cover 300 may cover the rear space of the inner space of the storage bin 27 so as to allow only the inner space of a front of the storage bin to be exposed to the outside. For example, in the inner part of the storage bin 27, only the front space at which the raising/lowering device 200 may be arranged may be exposed to the outside and the rear space may be covered by the inner cover 300.

The inner cover 300 may include a front surface cover 310 and an upper surface cover 320. The front surface cover 310 may be formed in a step shape and may partition an inside space of the storage bin 27 into a front space and a rear space. The upper surface cover 320 may be rotatably connected to an upper end of the front surface cover 310 and covers a rear upper surface of the front surface cover 310. For example, as illustrated in the drawings, the inner cover 300 may include the front surface cover 310 forming a vertical surface and the upper surface cover 320 formed horizontally by extending and rearward from the upper end of the front surface cover 310. In addition, the upper surface cover 320 may be connected to the upper end of the front surface cover 310 to be rotatable.

In addition, the front surface cover 310 may include an upper end portion (or upper end wall) 312, a step surface 314, and a lower end portion (or lower end wall) 316. The upper end portion 312 may be provided on the upper end of the front surface cover 310 to allow the upper surface cover 320 to be rotatably connected thereto, the step surface 314 may be formed by being bent perpendicularly forward from a lower end of the upper end portion 312 and extending, and the lower end portion 316 may be formed by being bent perpendicularly downward from an end of the step surface 314 and extending. For example, the front surface cover 310 may have the step shape lower end portion, and the step shape portion may prevent a user's finger from being inserted into a lower side of the drawer through a gap between the raising/lowering device 200 and the front surface cover 310.

An outer surface of the inner cover 300 may be made of a metal material as the outer side plate 27*a*. This construction may allow a user to feel the texture of metal and create aesthetic qualities and have rigidity since the inner cover 300 may be a part seen during the forward movement of the lower drawer 26 by the user.

A front surface and side surfaces of the storage bin 27 may also be made of a metal material. For example, when each part of the storage bin 27 may be made of the metal material, inner sides of the containing space of the storage bin 27 may entirely have the feel of metal, food stored therein may be stored to be entirely and evenly cold, and visually aesthetic qualities may be created for a user.

The raising/lowering device 200 may sit in the inner part of the storage bin 27. The raising/lowering device 200 has a structure of being vertically moved upward and downward by the driving device 400 connected thereto, which will be described, and, opposite sides of the raising/lowering device move upward and downward at the same rate To combine the raising/lowering device 200 with the driving device 400, a connection hole 27*b* may be provided at each of lower opposite sides of the front surface of the storage bin 27 by being formed therethrough in a front to rear direction of the front surface. The connection hole 27*b* may be a part into which the scissor side connection part 250 provided at the front end of the raising/lowering device 200 may be inserted to be received therein. For example, a radius of the connection hole 27*b* may be configured to be the same as or larger than a radius of the scissor side connection part 250.

In FIGS. 6 to 10, the configuration of the raising/lowering device 200 may be illustrated. For example, as illustrated in the drawings, the raising/lowering device 200, which may be configured to be a scissor type, may be folded when the raising/lowering device may be lowered and may be unfolded when the raising/lowering device may be raised such that the container 40 or food seated on the upper surface thereof may be moved upward and downward.

In addition, the raising/lowering device 200 may include the support plate 210 thereon. For example, as illustrated in the accompanying drawings, the support plate 210 may be provided on an upper end of the raising/lowering device 200 to allow the container 40 laid on an upper side thereof to be efficiently seated.

The support plate 210, which constitutes an outer surface of the upper surface of the raising/lowering device 200, may be configured to have a particular thickness and may be made of a metal such as a stainless material to be aesthetic, and may be configured such that an inner part of the support plate may be depressed so as to allow the container 40 to be efficiently seated and fixed. The raising/lowering device 200 may be provided on an inner bottom of the storage bin 27 and may be removably provided at an inner side of the storage bin 27.

The raising/lowering device 200 may include the upper frame 220 provided at the upper side thereof, a lower frame 230 provided under the upper frame 220, and a pair of scissor assemblies 240 arranged between the upper frame 220 and the lower frame 230. As illustrated in the drawings, the upper frame 220 may be configured to have a rectangular frame shape, and the support plate 210 sits on and may be fixed to an upper surface of the upper frame 220.

The upper frame 220 of the raising/lowering device 200 moves in upward and downward directions and substantially supports food or the container 40 together with the support plate 210. The upper frame 220 may be configured to have a metal plate shape, and edges thereof may be partially bent downward. For example, the upper frame 220 may be configured to define a space to house each of the scissor assemblies 240 in cooperation with the lower frame 230.

The lower frame 230 may be provided under the upper frame 220 and sits on a bottom surface of the storage bin 27. Furthermore, the lower frame 230 may be configured to have a shape corresponding to a shape of the upper frame 220. The lower frame 230 may also be configured to have a metal plate shape as the upper frame 220, and edges thereof may be bent upward. For example, the lower frame 230 may be configured to define the space to house each of the scissor assemblies 240 together with the upper frame 220.

The raising/lowering device 200 may be configured to be unfolded or folded upward and downward by the scissor assemblies 240. For example, to allow the raising/lowering device 200 to be folded, a locking mechanism 500 may be used. The locking mechanism 500 may allow the lower frame 230 and the upper frame 220 to be brought close to each other to vertically fold the raising/lowering device 200 such that a vertical length of the locking mechanism 500 may be minimized. For example, the locking mechanism 500 may include the upper locking mechanism 510 provided in the upper frame 220 and the lower locking mechanism 520 provided in the lower frame 230.

For example, the lower locking mechanism 520 may be provided at a middle of the lower frame 230. The lower locking mechanism 520 functions to allow the upper frame 220 and the lower frame 230 to be not randomly separated from each other and to be in a state of restricting each other when the raising/lowering device 200 may be removed from the storage bin. For example, the lower locking mechanism 520 allows the scissor assemblies 240 to maintain the folded state thereof without unfolding.

Figure 10:
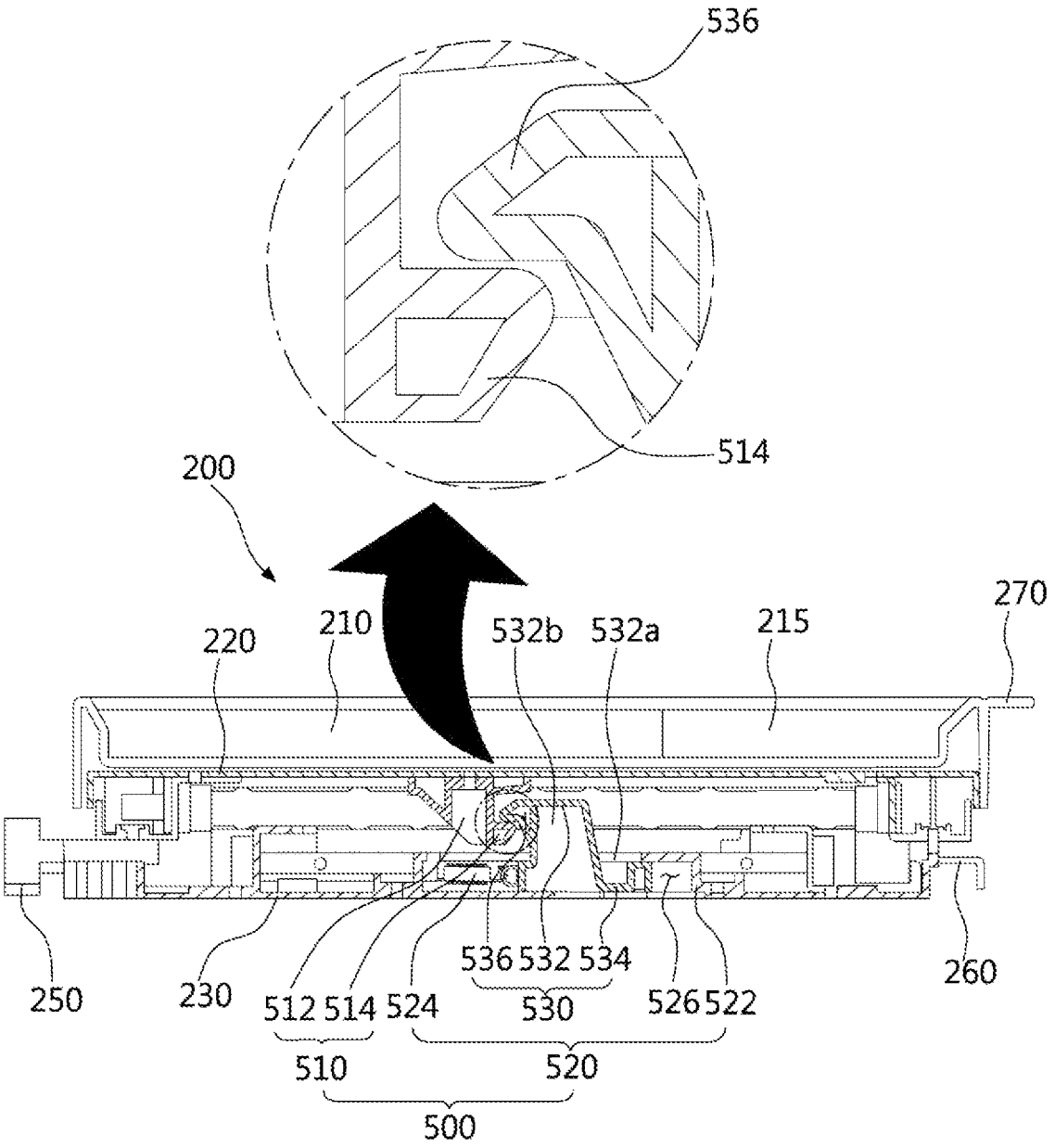
FIG. 10 is a right side sectional view illustrating the configuration of the raising/lowering device according to an embodiment of the present disclosure.
Figure 11:
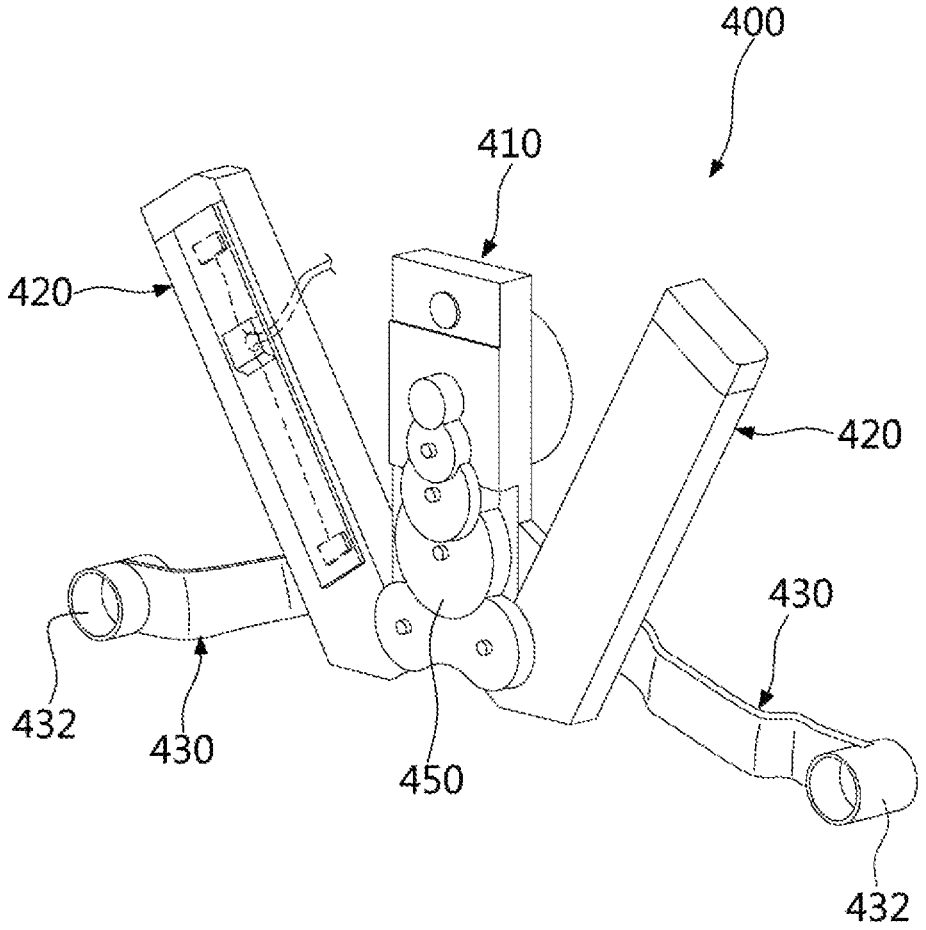
FIG. 11 is a perspective view illustrating configuration of a driving device according to an embodiment of the present disclosure.
Figure 12:
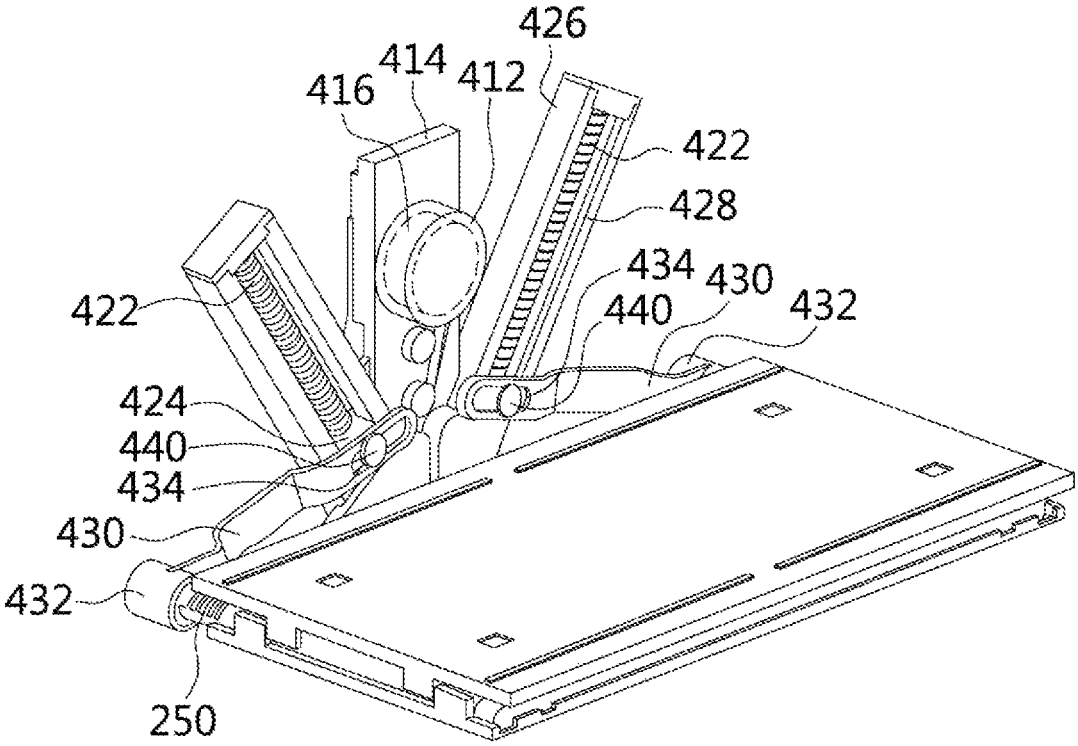
FIG. 12 is a rear perspective view illustrating the configuration of each of the driving device and the raising/lowering device according to an embodiment of the present disclosure.
Figure 13:
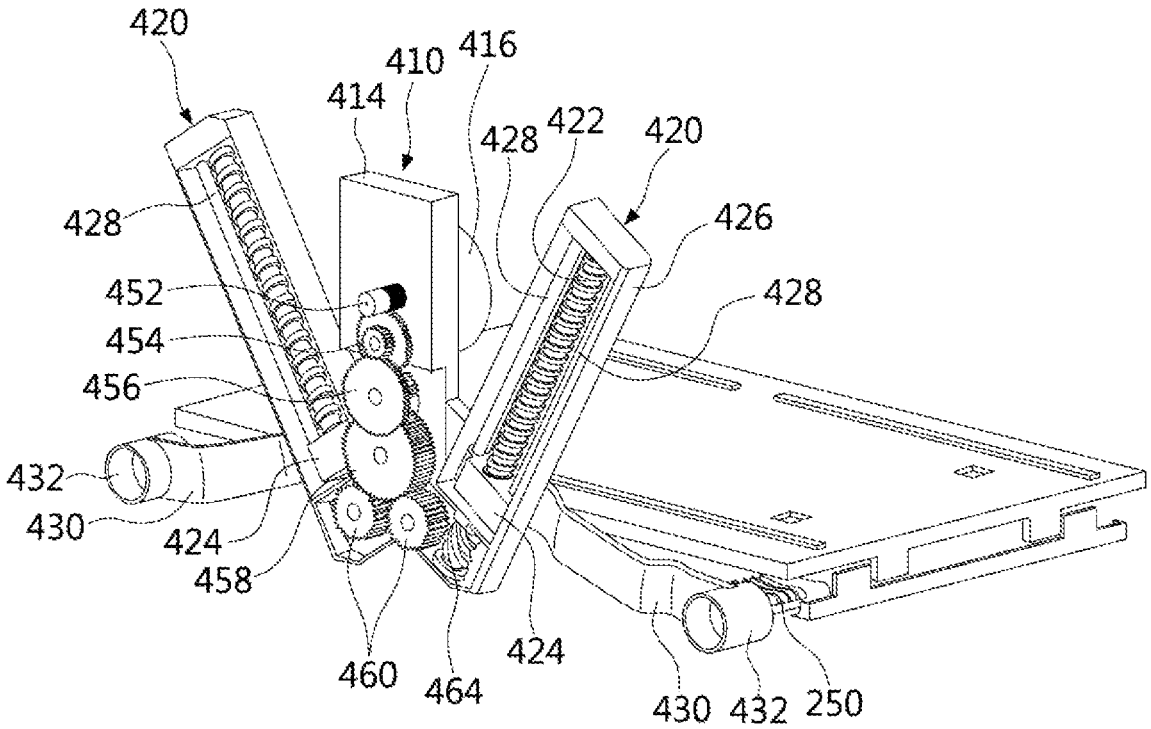
FIG. 13 is a front perspective view illustrating the configuration of each of the driving device and the raising/lowering device according to an embodiment of the present disclosure.

The lower locking mechanism 520 may include a locking casing 522 fixed to the middle of the lower frame 230, a lower hook 530 moving in the locking casing 522, and a force applying member (or spring) 524 applying a unidirectional force to the lower hook 530. For example, the lower locking mechanism 520 may be provided at the middle of an upper surface of the lower frame 230 by protruding upward therefrom. In addition, as illustrated in FIG. 10, the locking casing 522 may be configured to have a particular front to rear length (to opposite sides of FIG. 10) and a hook space 526 having volume of a particular size may be provided in the locking casing 522.

The lower hook 530 may include a hook body 532 having a particular vertical height, a support end 534 provided at a lower end of the hook body 532 to support the hook body 532, and a hook end 536 protruding by extending forward from an upper end of the hook body 532. The hook body 532 may be configured to have the particular vertical height and a hook hole 532*a* may be provided in an upper surface of the locking casing 522 by being vertically formed therethrough. For example, the hook hole 532*a* having a particular front to rear length may be provided in the upper surface of the locking casing 522 by being vertically formed therethrough, and the hook body 532 may be arranged by vertically passing through the hook hole 532*a*.

The hook body 532 may be configured such that an inner part thereof may be hollow and a lower part thereof may be open. For example, the inner part of the hook body 532 may be hollow and the lower part thereof may be open to have a protrusion groove 532*b*. A spacing protrusion 27*c*, which will be described hereinbelow, may be received in the protrusion groove 532*b*. For example, a front to rear thickness of the hook body 532 may be configured to gradually decrease toward the upper end of the hook body. As illustrated in FIG. 10, at least a rear surface (e.g., a right surface of the hook body of FIG. 10) of the hook body 532 may be configured to be gradually inclined so as to be positioned at a further rear side toward a lower side thereof.

The front to rear length of the hook hole 532*a* may be configured to have a size larger than a size of the thickness of the hook body 532 provided to pass through the hook hole 532*a*. For example, the hook body 532 may be allowed to move a particular distance forward and backward while the hook body 532 may be received in the hook hole 532*a*.

As illustrated in FIG. 10, the support end 534 may be configured to extend forward and backward (to opposite sides of FIG. 10) at a lower end of the hook body 532 and vertically extend therefrom and may be a part moving forward and backward (to the opposite sides of FIG. 10) in the locking casing 522.

The hook end 536 may be provided to protrude by a particular portion by perpendicularly bending to a front (a left side of FIG. 10) of the hook body 532 from the upper end thereof and has a shape corresponding to a shape of an upper hook end 514 of the upper locking mechanism 510, which will be described hereinbelow.

The force applying member 524 may be provided in the locking casing 522 and functions to pull the lower hook 530 forward (to the left side of FIG. 10). For example, the force applying member 524 may be configured as a tension spring and functions to pull the lower hook 530 forward by tensile elasticity. A front of the force applying member 524 may be connected to a front surface of an inner side of the locking casing 522 and a rear end of the force applying member may be connected to a front end of the support end 534.

In other examples, the force applying member 524 may be made of various materials as long as the force applying member has function of pushing or pulling the lower hook 530 forward by the elasticity. For example, the force applying member 524 may be provided as an elastic spring and installed at a rear side of the support end 534 to push the lower hook 530 forward by an elastic force.

The upper frame 220 may include the upper locking mechanism 510 provided on a middle portion of a lower surface of the upper frame 220. As illustrated in the accompanying drawings, the upper locking mechanism 510 may be provided by protruding downward from the lower surface of the upper frame 220 and has a shape corresponding to a shape of the lower hook 530 such that the upper locking mechanism and the lower hook may be engaged with each other. For example, a lower end of the upper locking mechanism 510 may be bent perpendicularly rearward (to the right side of FIG. 10), thereby being held by the hook end 536 of the lower hook 530.

The raising/lowering device 200 may be required to freely fold and unfold, but when the raising/lowering device 200 may be removed upward from the storage bin, the raising/lowering device 200 may be required to maintain the folded state thereof. For example, the raising/lowering device 200 may be required to unfold when the container 40 sits on an upper side of the raising/lowering device 200 to be moved upward and downward. However, when the raising/lowering device 200 may be removed to the outside since the raising/lowering device may be not used, the raising/lowering device 200 may be required to be removed upward with the raising/lowering device folded.

For example, the anti-loosening device may be provided to allow the raising/lowering device 200 to be rotated relative to the front end thereof such that the folded state of the raising/lowering device 200 may be maintained when the raising/lowering device 200 may be moved upward and removed from the storage bin.

The anti-loosening device may include the locking mechanism 500 that prevents the raising/lowering device 200 from unfolding and a handle 215, which will be described hereinbelow. For example, apart from the locking mechanism 500, the handle 215 configured to be held by a user may be provided at each of rear end parts of opposite side edges of the raising/lowering device 200 so as to allow the raising/lowering device 200 to be rotated relative to the front end thereof.

For example, when a user holds and lifts the handle 215 provided at the rear end part of the raising/lowering device 200, the raising/lowering device 200 may be naturally rotated relative to the front end thereof. For example, the lower locking mechanism 520 escapes from the spacing protrusion 27*c*, which will be described hereinbelow, and the folded state of the raising/lowering device 200 may be maintained by the locking mechanism 500.

The scissor assemblies 240 may be provided at opposite sides of the upper frame 220 and the lower frame 230 relative to a middle of each of the upper frame and the lower frame. In some examples, each of the scissor assembly 240 may be axially coupled to the upper frame 220 and the lower frame 230. For example, the upper frame 220 may move upward and downward according to the movement of the scissor assembly 240.

Each of the pair of scissor assemblies 240 provided at the opposite sides may be different only in an installation position and may be exactly the same in a structure and shape thereof. For example, as illustrated in the accompanying drawings, the distance between the upper frame 220 and the lower frame 230 may be decreased or increased by the movement of the scissor assembly 240 having an "X" shape as a whole at each of the opposite sides.

The scissor assembly 240 may include a plate-shaped plate unit (or plate) 242 and a rod unit 244 (or rod) axially coupled to intersect with the plate unit 242. In some examples, the plate unit 242 may be rotatably mounted to the lower frame 230. For example, the plate unit 242 may be rotatably installed at each of opposite ends of the lower frame 230. The rod unit 244 may be rotatably connected to the upper frame 220. For example, the rod unit 244 may be rotatably installed at each of opposite ends of the upper frame 220.

The plate unit 242 may be configured to be a rectangular plate shape and be made of aluminum alloy materials. For example, the plate unit may be formed to have high rigidity and be light, and may also be formed by die casting. The plate unit 242 may include the scissor side connection part 250 provided at a lower end thereof by protruding therefrom. For example, the scissor side connection part 250 may be provided at a front end of the plate unit 242 by further protruding forward to be integrated with the plate unit.

The rod unit 244 may be installed to intersect the plate unit 242. For example, the rod unit 244 and the plate unit 242 unfold to have an "X" shape (as viewed from a front thereof) by intersecting each other, and an intersecting shaft 246 may be provided at a center portion at which the rod unit 244 and the plate unit 242 intersect each other such that the rod unit 244 and the plate unit 242 rotatably intersect each other.

Ends of the rod unit 244 and the plate unit 242 may be in contact with the lower surface of the upper frame 220 and the upper surface of the lower frame 230 and accordingly, the rod unit 244 and the plate unit 242 may be configured to slidably move. For example, a lower end (in FIG. 6) of the plate unit 242 may be rotatably mounted to the lower frame 230 and an upper end of the plate unit 242 may be installed on the lower surface of the upper frame 220 to slidably move. For example, an upper moving guide 252 may be provided on the lower surface of the upper frame 220 to have a particular length to opposite sides thereof and may be in contact with the upper end of the plate unit 242 to guide the plate unit such that the plate unit slidably moves. In some examples, a roller rotating along the upper moving guide 252 may be provided at the upper end of the plate unit 242.

An upper end (in FIG. 6) of the rod unit 244 may be rotatably mounted to each of the opposite ends of the upper frame 220, and a lower end of the rod unit 244 may be slidably installed on the upper surface of the lower frame 230. For example, a lower moving guide 254 may be installed on the upper surface of the lower frame 230 to have a particular length to opposite sides thereof and may be in contact with the lower end of the rod unit 244 so as to guide a sliding movement of the rod unit. A roller rotating along the lower moving guide 254 may be provided at the lower end of the rod unit 244.

A rear end hook 260 having a hook shape may be provided at a rear end (a right end of FIGS. 8 and 10) of the lower frame 230 by extending backward, and a second cover that includes a cover piece (or cover ledge) 270 may be provided at a rear end of the support plate 210 by extending backward therefrom to prevent a user's finger being trapped. The rear end hook 260 may be held by a lower end of the inner cover 300 and the cover piece 270 covers a gap between the raising/lowering device 200 and the inner cover 300. In addition, the handle 215, which will be described hereinbelow, may be provided at each of rear end parts of the opposite side edges of the support plate 210.

As illustrated in these drawings, a driving device 400 may be arranged in the front panel 28 and may be connected to the raising/lowering device 200 provided at a rear side thereof. For example, power generated by the driving device 400 may be transmitted to the raising/lowering device 200. The driving device 400 may transmit power simultaneously to the opposite sides of the raising/lowering device 200. For example, the raising/lowering device 200 may move upward and downward in parallel in the opposite sides thereof without slanting.

The driving device 400 may include a motor assembly 410, a screw unit 420 arranged at each of opposite sides of the motor assembly 410 to have a pair of screw units, and a lever 430 connected to each of the screw units 420 to have a pair of levers. In addition, the screw unit 420 may include a screw 422 and the screw holder 424, through which the screw 422 passes, moving upward and downward along the screw 422.

A lever connection part 432 may be provided at an end of the lever 430 and the lever connection part 432 may be rotatably fixed to a rear surface of the front panel 28. The lever connection part 432 may be combined with the scissor side connection part 250.

A lever hole 434, into which a holder engaging member 440 may be locked, may be provided in an inner end of each of the pair of the levers 430. The lever hole 434, which may be configured to be a longitudinal hole, guides movement of the holder engaging member 440 and at the same time allows the holder engaging member 440 to be engaged with the screw holder 424. For example, the lever 430 may be rotated by the screw holder 424 moving upward and downward during rotation of the screw 422.

The motor assembly 410 may be positioned at a middle portion of the front panel 28. A drive motor 412 may be provided in the motor assembly 410 and the screw units 420 and the levers 430 of the opposite sides of the motor assembly 410 may be operated by the motor assembly 410 including the drive motor 412.

The motor assembly 410 may allow speed reduction and a magnitude of a transmitted force to be adjusted by combination of multiple gears. In addition, the motor assembly 410 has a structure of having the drive motor 412 and the gears vertically arranged so as to minimize a recessed space of the front panel when the motor assembly 410 may be installed in the front panel 28. For example, to minimize a thickness of the motor assembly 410, a width of opposite side directions thereof may be configured to be wide and a thickness of forward and backward directions thereof may be configured to be minimized.

In addition, the drive motor 412 constituting the motor assembly 410 protrudes to the storage bin 27 so as to allow a recessed depth of the front panel 28 to be minimized such that a thermal insulation performance of the front panel may be guaranteed. The drive motor 412 provides power to the raising/lowering device 200 such that the raising/lowering device 200 may be moved upward and downward and may be configured to rotate clockwise/counterclockwise. For example, when an upward or downward moving signal of the raising/lowering device 200 may be input, the drive motor 412 rotates clockwise or counterclockwise and provides power to the raising/lowering device 200 so that the raising/lowering device may be moved upward and downward. Furthermore, the drive motor 412 may be stopped at the input of a stop signal by a load thereof or detection of a sensor.

The motor assembly 410 may include the drive motor 412, a motor casing 414 in which the drive motor 412 may be installed, and a motor cover 416 with which the motor casing 414 may be combined and covers the drive motor 412. A rotating shaft of the drive motor 412 may protrude from the motor casing 414 toward a side opposite to a side of the motor cover 416.

Furthermore, the motor assembly 410 may further may include a power transmission part (or power transmission gears) to transmit the power of the drive motor 412. The power transmission part may be positioned at a side opposite to a side of the drive motor 412 relative to the motor casing 414. The power transmission part may be configured by the combination of the multiple gears and may be covered by a cover member 450 mounted at a side (a front of the motor casing) opposite to the side of the drive motor 412.

Figure 14:
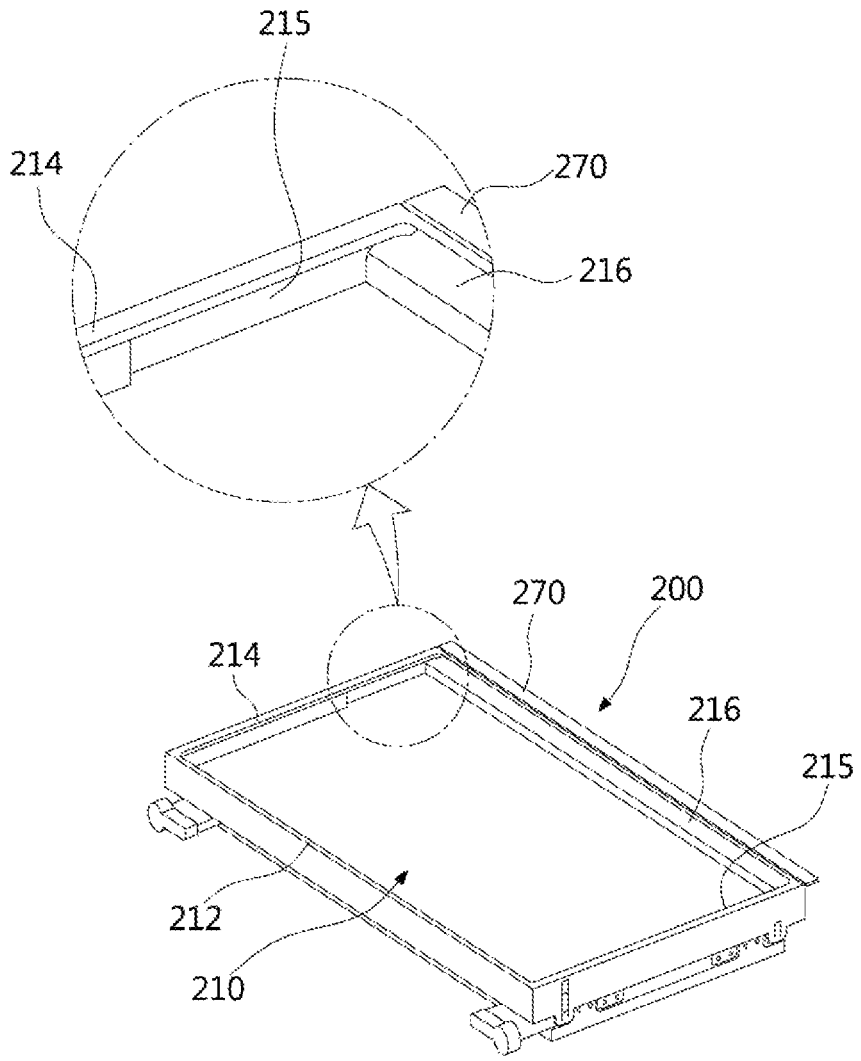
FIG. 14 is a perspective view illustrating a state of the raising/lowering device folded according to an embodiment of the present disclosure.

The power transmission part may include a drive gear 452 connected to the shaft of the drive motor 412 passing through the motor casing 414, a first transmission gear 454 provided at a lower side of the drive gear 452 to mesh therewith, a second transmission gear 456 meshing with the first transmission gear 454, a third transmission gear 458 meshing with the second transmission gear 456, and a pair of cross gears 460 meshing with the third transmission gear 458. In addition, as illustrated in FIG. 14, the second transmission gear 456 meshing with the first transmission gear 454 may be configured as a multi-stage gear to mesh with the upper and lower gears each other.

The cross gears 460 may be configured to may include spur gears and helical gears. For example, a first helical gear part may be provided at a rear of each of the cross gears 460 configured to have a spur gear shape, and the first helical gear part meshes with a second helical gear part 464 of a side of each of the cross gears.

A rotation center line of the second helical gear part 464 may be arranged to intersect a rotation center line of the cross gear 460. For example, the first helical gear part and the second helical gear part 464 may be combined with each other in a state intersecting with each other and may be configured to be engaged with each other so as to allow rotations thereof to be transmitted to each other.

The rotation center line of the cross gear 460 extends in a front to rear direction thereof and the rotation center line of the second helical gear part 464 extends in an inclined vertical direction. Furthermore, as illustrated in FIG. 14, each of the rotation center lines of the second helical gear parts 464 arranged at the opposite sides of the cross gears may be arranged to be inclined in a direction gradually moving away from each other upward.

The screw unit 420 may be arranged at each of the opposite sides of the motor assembly 410. The screw unit 420 may be arranged at each of the opposite sides of an inner side of the front panel 28 and each of the pair of the screw units 420 may be different only in an installation position thereof, but may be the same in a structure and shape thereof.

The power of the drive motor 412 may be transmitted to a lower part of the screw unit 420. Each of the screw units 420 of the opposite sides may be configured to be symmetrical to each other relative to the motor assembly 410. For example, the motor assembly 410 may be arranged between the screw units 420 positioned at the opposite sides, and each of the screw units 420 arranged at the opposite sides may be arranged to have a shorter distance therebetween toward a lower end thereof from an upper end thereof.

The screw unit 420 may include the screw 422 rotated by receiving the power of the drive motor 412, wherein the screw 422 extends in upward and downward directions and may be configured to be inclined such that an upper end thereof faces an outside thereof and a lower end thereof faces an inside thereof. The screw 422 may be connected to the second helical gear part 464. For example, the screw 422 rotates together with the second helical gear part 464 during rotation thereof.

The screw unit 420 may also include the screw holder 424 through which the screw 422 passes to be combined therewith, wherein the screw holder 424 moves upward and downward along the screw 422 during rotation of the screw 422. In addition, since the lever 430 may be combined with the screw holder 424, the lever 430 rotates during movement of the screw holder 424. For example, during the rotation of the screw 422, the screw holder 424 moves along the screw 422.

In addition, a magnet may be provided in the screw holder 424. The magnet may be provided such that a position of the screw holder 424 may be detected and when the screw holder 424 may be positioned at a lowest end or a top end of the screw 422, the raising/lowering detection sensor device detects this. For example, completion of an upward or downward movement of the raising/lowering device can be determined by whether the magnet installed in the screw holder 424 may be detected. The lever 430 may connect the screw holder 424 with the raising/lowering device 200 and each of opposite sides of the lever may be combined with each of the screw holder 424 and the raising/lowering device 200.

The screw unit 420 may further include a housing 426 receiving the screw unit 420. The housing 426 may include an outer surface of the screw unit 420 and may include a space in which the screw unit 420 and the screw holder 424 may be received. The housing 426 may be formed by bending a plate shaped metal material or may be formed of a plastic material.

The housing 426 may include at least one guide bar 428 to guide lifting of the screw holder 424. The at least one guide bar 428 extends in parallel with the screw 422 while being spaced apart from the screw 422. A plurality of guide bars 428 may be provided in the housing 426 such that the screw holder 424 may be not displaced to any side of a left or right side relative to the screw 422, and the screw 422 may be positioned between the plurality of guide bars 428.

The motor casing 414 and a pair of housings 426 may be provided to be integrated with each other. Furthermore, a single cover member 450 may cover the motor casing 414 and the pair of housings 426. For example, the cover member 450 may be combined with the motor casing 414 to cover the power transmission part, and may be combined with the pair of housings 426 to cover the screw 422, the guide bars 428, and the screw holder 424. Since the driving device 400 exists as a module, the driving device 400 becomes compact and thus the driving device 400 can be easily installed in the front panel 28.

Figure 15:
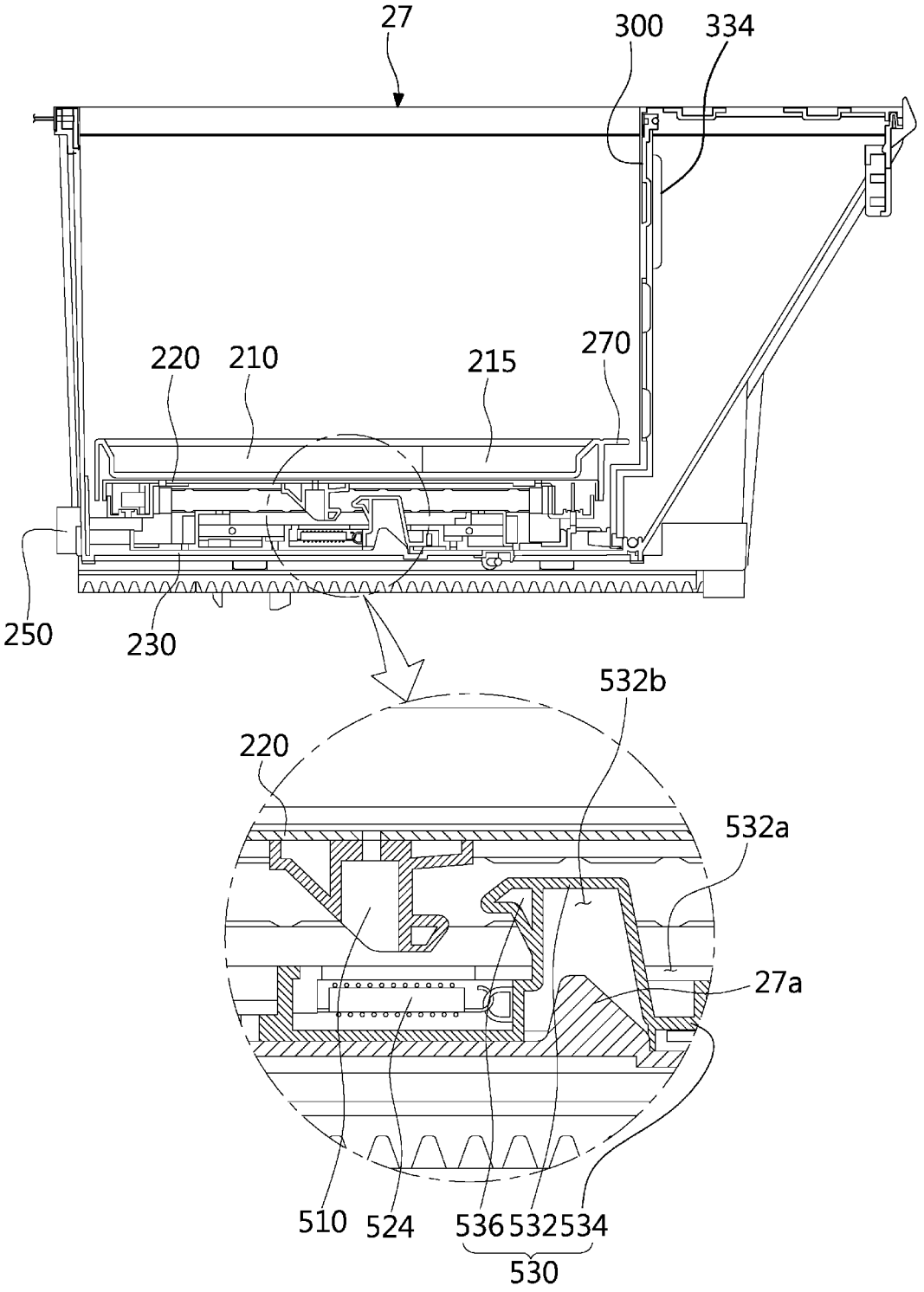
FIG. 15 is a sectional view illustrating a state of the raising/lowering device mounted in the storage bin according to an embodiment of the present disclosure.

FIG. 14 is a perspective view of a state of the raising/lowering device folded according to the present disclosure. As illustrated in FIG. 15, the support plate 210 constitutes an upper outer surface of the raising/lowering device 200. In addition, the support plate 210 may be a rectangular flat plate as a whole, and each of edges thereof protrudes upward to have a particular height. For example, the upper surface of the support plate 210 may be entirely formed such that an inner part of each of the edges thereof may be depressed, so that a lower end of the container 40 may be easily seated.

The edges of the support plate 210 may include a front edge 212 provided by protruding upward from an upper surface of a front end thereof, side edges 214 provided by protruding upward from opposite sides thereof, and a rear edge 216 provided by protruding upward from an upper surface of a rear end thereof.

An upper end of the rear edge 216 extends backward to have the cover piece 270, and as described above, the cover piece 270 covers the gap between the raising/lowering device 200 and the inner cover 300 such that fingers of a user or a child may be prevented from being trapped in the gap.

Each of the side edges 214 may include the handle 215 at the rear end part thereof. The handle 215 may be a part held by fingers of a user when the user takes out the raising/lowering device 200 from the inner part of the storage bin 27. As illustrated in the drawings, the handle 215 may be configured to be recessed from an inner surface of each of the pair of the opposite side edges 214 to an outer side thereof. For example, a user moves his/her fingers from a middle of the upper surface of the support plate 210 to each of the pair of side edges 214, puts his/her fingers in the recessed portion of the handle 215, and lifts the raising/lowering device upward. For example, the raising/lowering device 200 rotates relative to the front end thereof and the rear end part thereof may be lifted upward.

Figure 16:
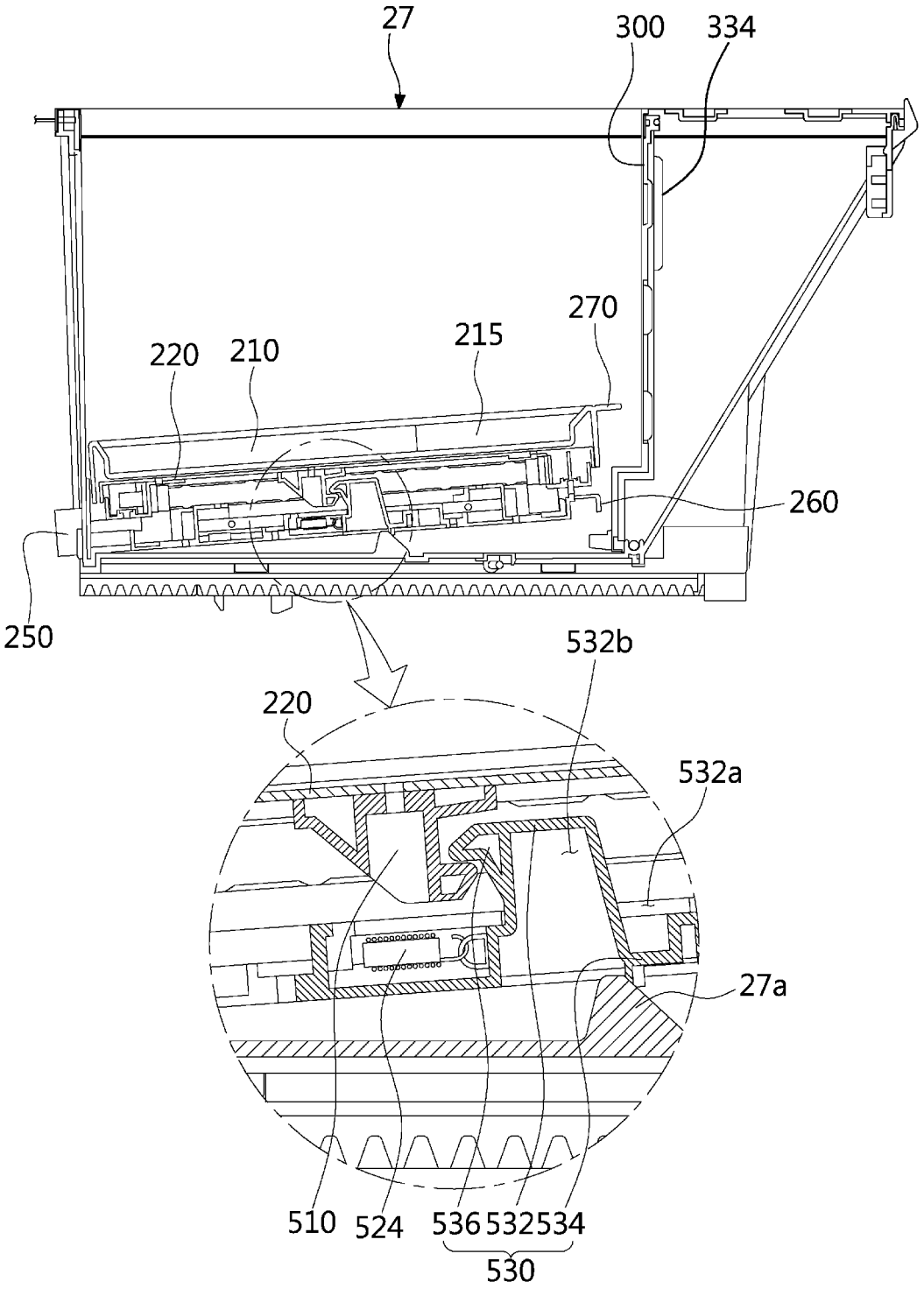
FIG. 16 is a sectional view illustrating a state of the raising/lowering device moved upward while being mounted in the storage bin according to an embodiment of the present disclosure.

FIG. 15 may be a sectional view of a state of the raising/lowering device 200 mounted in the storage bin 27, and FIG. 16 may be a partial sectional view illustrating a state at which the raising/lowering device 200 mounted in the storage bin 27 may be lifted upward. As illustrated in FIG. 15, the raising/lowering device 200 sits on the bottom surface of the inner part of the storage bin 27. For example, the scissor side connection part 250 of the raising/lowering device 200 passes through the connection hole 27*b* of the storage bin 27 and accordingly, a front end of the scissor side connection part 250 protrudes to the front (a left side of FIG. 15) of the storage bin 27.

In addition, the lower hook 530 moves backward (a right side of FIG. 15) and may be separated from the upper locking mechanism 510. For example, the upper frame 220 and the lower frame 230 may be not locked to each other in the folded state. For example, the storage bin 27 may include the spacing protrusion 27*c* provided at a middle part thereof by protruding upward therefrom, and the lower hook 530 may be moved backward (the right side of FIG. 15) by the spacing protrusion 27*c*.

As illustrated in FIG. 16, the spacing protrusion 27*c* may be configured to have a "Δ" shape having a pointed upper side. For example, although a front surface (a left-side surface of FIG. 15) of the spacing protrusion 27*c* may be vertically configured, a rear surface thereof (a right-side surface of FIG. 15) may be required to be configured slantingly. This design may be because a rear end part of the protrusion groove 532*b* of the lower hook 530 may be in a sliding contact with the rear surface of the spacing protrusion 27*c* therealong.

For example, the upper locking mechanism 510 and the lower hook 530 of the raising/lowering device 200 may be engaged with each other to maintain the folded state thereof outside of the storage bin 27. For example, when the raising/lowering device 200 of the folded state may be installed on the bottom surface from an upper part of the storage bin 27, the raising/lowering device 200 may be brought into a close contact with the bottom surface of the storage bin 27 by weight.

For example, the rear surface of the spacing protrusion 27*c* may be in contact with a rear end of a lower surface of the hook body 532 of the lower hook 530. As the raising/lowering device 200 gradually lowers downward, the elasticity of the force applying member 524 configured as the tension spring does not overcome a downward moving force of the raising/lowering device 200, and accordingly, the rear end of the lower surface of the hook body 532 of the lower hook 530 gradually slides along the rear surface of the spacing protrusion 27*c* as illustrated in FIG. 15.

The spacing protrusion 27*c* may be received in the protrusion groove 532*b* provided in the hook body 532, and the lower hook 530 and the upper locking mechanism 510 may be spaced apart from each other and accordingly may be not engaged with each other. For example, the spacing protrusion 27*c* may be received in the protrusion groove 532*b*, and the lower locking mechanism 520 and the upper locking mechanism 510 may be separated from each other such that the locking mechanism 500 may be unlocked. For example, the raising/lowering device 200 may be in a state which can be unfolded. For example, to maintain the folded state of the raising/lowering device 200, the spacing protrusion 27*c* may be required to escape from the protrusion groove 532*b*.

As described above, to take out the raising/lowering device 200 upward while the raising/lowering device 200 sits on the bottom surface of the storage bin 27, the handle 215 may be lifted upward while the handle may be held by each of the hands. For example, while the raising/lowering device 200 rotates counterclockwise relative to the front end part thereof, the rear end part thereof (a right end of FIG. 15) may be lifted upward.

When the rear end part of the raising/lowering device 200 may be moved upward, the rear end of the lower surface of the hook body 532 of the lower hook 530 gradually may be moved upward by sliding along the rear surface of the spacing protrusion 27*c*.

When the rear end of the raising/lowering device 200 moves up, the raising/lowering device 200 slants gradually. Since the force applying member 524 may be the tension spring, the force applying member continuously pulls the lower hook 524 forward. For example, the lower hook 524 moves forward while moving upward gradually and thus may be engaged with the upper locking mechanism 510. For example, as illustrated in FIG. 16, before the lower end of the lower hook 524 moves away from the upper end of the spacing protrusion 27*c*, the lower hook 524 and the upper locking mechanism 510 may be engaged with each other.

In one example, since the lower hook 524 of the lower locking mechanism 520 and the upper locking mechanism 510 may be engaged with each other when the rear end part of the raising/lowering device 200 may be lifted upward, the raising/lowering device 200 may be maintained at the folded state and the scissor side connection part 250 deviates from the connection hole 27*b* of the storage bin 27. For example, the raising/lowering device 200 may be completely removed from the upper side of the storage bin 27.

Figure 17:
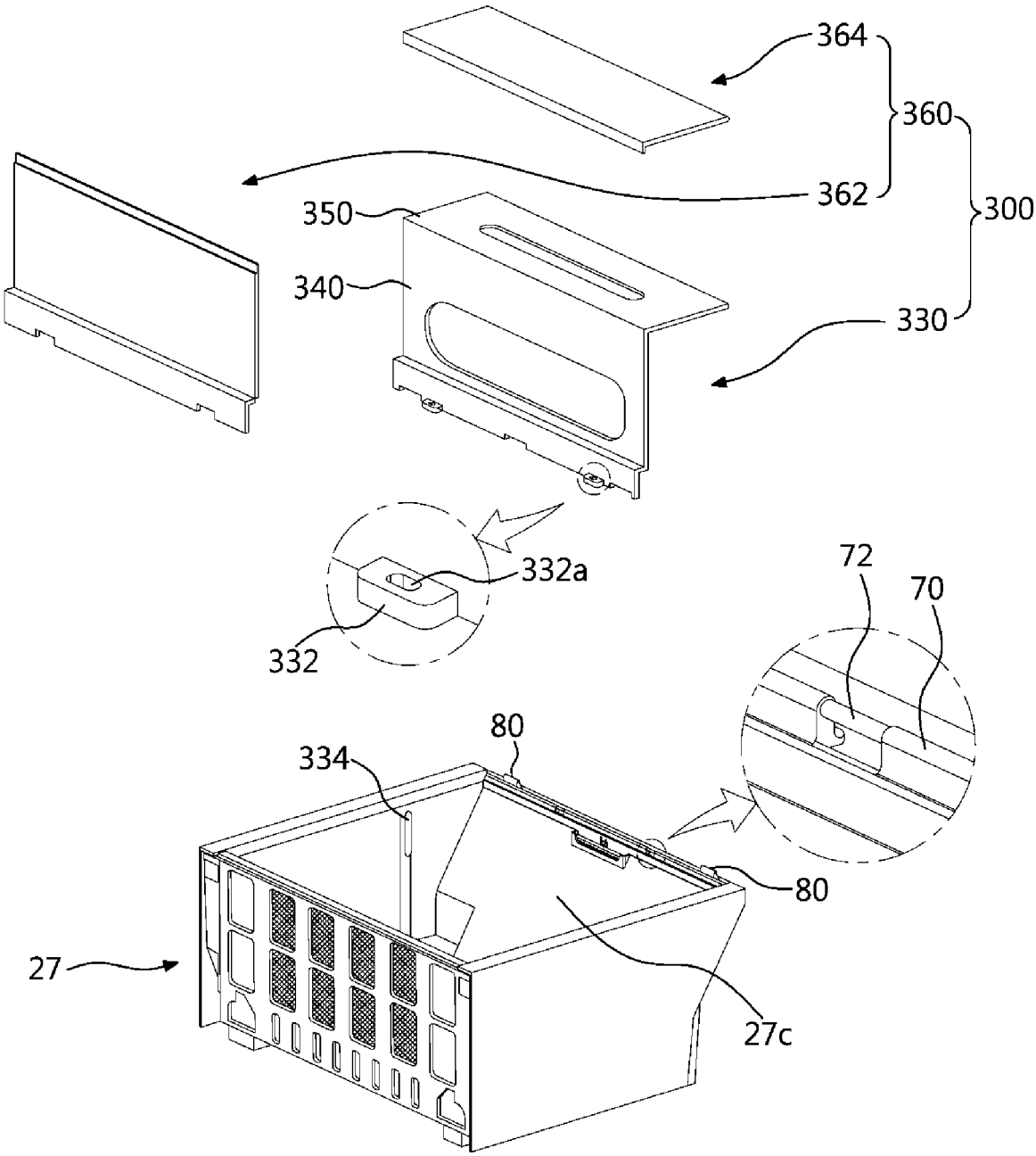
FIG. 17 is an exploded-perspective view illustrating configuration of an inner cover separated from the storage bin according to an embodiment of the present disclosure.

FIG. 17 may be an exploded-perspective view illustrating configuration of the inner cover 300 separated from the storage bin 27 according to the present disclosure. As described above, the inner cover 300 may cover the rear end portion of the inner space of the storage bin 27. For example, the inner cover 300 may include the front surface cover 310 and the upper surface cover 320. The front surface cover 310 partitions the inner space of the storage bin 27 into the front space and the rear space and may be formed in a step shape, and the upper surface cover 320 may be rotatably connected to the upper end of the front surface cover 310 and covers the rear upper surface of the front surface cover 310.

In addition, the front surface cover 310 may be including the upper end portion 312, the step surface 314, and the lower end portion 316. The upper end portion 312 may be provided for rotatable connection of the upper surface cover 320, the step surface 314 may be formed by being bent perpendicularly forward from the lower end of the upper end portion 312 and extending, and the lower end portion 316 may be formed by being bent perpendicularly downward from the end of the step surface 314.

In addition, the inner cover 300 may include a main member (or main frame) 330 forming a frame of the inner cover 300 and an exterior material (or exterior cladding) 360 forming an exterior of the inner cover 300. In some examples, the main member 330 may be made of an injection molded article by injection molding, and an entire shape thereof may be molded in a '⅃' shape (or inverted "L" shape), as shown from right side of the drawings. In addition, the exterior material 360 may be coupled to each of a front surface and an upper surface of the main member 330 to form appearance of the front and upper surfaces thereof.

In some examples, the exterior material 360 may be formed of metal material or a clad material. For example, the exterior material 360 may be formed to cover the front and upper surfaces of the main member 330 made of the injection molded article and functions to form a neat appearance. For example, the exterior material 360 may be formed of a material that creates a luxurious texture.

The metal material may be excellent in gloss and easy to be deformed and may be frequently used in household goods and interior products. In addition, in order to prevent a disadvantage that the metal material rusts more than stainless steel and aluminum, surfaces of the products may be coated or painted separately.

The clad material may be advanced new materials that combine several different metals together to take advantage of each metal. Among them, it may be preferable to use a material in which aluminum having excellent thermal conductivity, heat preservation rate, and thermal efficiency may be combined with stainless steel having excellent flame resistance, acid resistance, alkali resistance, and corrosion resistance.

The main member 330 may include a front surface member (or front surface wall) 340 and an upper surface member (or upper surface wall) 350. The front surface member 340 may be installed vertically inside the storage bin 27, and the upper surface member 350 may be rotatably connected to an upper end of the front surface member 340 and covers a rear upper end of the front surface member 340.

In addition, the exterior material (or exterior cladding) 360 may include a front exterior material 362 and an upper exterior material 364. The front exterior material (or front exterior cladding) 362 may be installed adjacent to or to contact a front surface of the front surface member 340 and the upper exterior material (or upper exterior cladding) 364 may be installed adjacent to or to contact with an upper surface of the upper surface member 350.

In addition, the front exterior material 362 may be provided as a separate structure from the upper exterior material 364. For example, the front exterior material 362 and the upper exterior material 364 may be configured separately from each other and may be respectively installed to cover the front surface of the front surface member 340 and the upper surface of the upper surface member 350.

A locking end 332 may be provided on a lower end of the front surface member 340. As illustrating in the drawings, the locking end 332 may be formed by protruding forward from the lower end of the front surface member 340, and may be provided as two locking ends 332 from side to side. The locking end 332 may be a location where the rear end hook 260 may be held and fastened. For example, the locking end 332 may be including a hook hole 332*a* penetrating vertically. For example, the rear end hook 260 may be inserted into the hook hole 332*a* provided in the locking end 332. The hook hole 332*a* may be formed by penetrating the locking end 332 vertically, but may be formed in a groove shape on the locking end 332. For example, the hook hole 332*a* may be formed in a groove depressed downward from an upper surface of the locking end 332.

A bump 334 may be provided on an inner side surface of the storage bin 27 for preventing rearward movement of the inner cover 300. For example, on left and right inner side surfaces of the storage bin 27, a pair of preventing steps 334 may be formed to face each other. As illustrating in the drawings, each of the preventing steps 334 may be formed on an upper half portion of the inner side surface of the storage bin 27 with a particular length up and down.

In addition, the bump 334 may be formed to have elasticity. For example, the bump 334 may be integrally formed with the inner side surface of the storage bin 27 which may be formed of the same material of the exterior material 360 of the inner cover 300, and a part of the inner side surface of the storage bin 27 protrudes inward to form the bump 334.

The bump 334 has elasticity to be moveable from side to side. For example, the bump 334 may have elasticity by a shape or a material thereof, and may be configured to be moveable from side to side by elasticity of the inner side surface of the storage bin 27 which may be integrally formed therewith. For example, when a particular external force may be applied to the front surface cover 310 of the inner cover 300 which may be positioned in front of the bump 334, the preventing steps 334 may be retracted leftward and rightward by elasticity and the front surface cover 310 may be moveable rearward.

When at least a force of about 3N is applied to the front surface cover 310 from the front, the bump 334 may be designed to be retracted leftward and rightward so that an upper end of the front surface cover 310 may be moved rearward. When the upper half portion of the front surface cover 310 may be moved rearward by passing through the bump 334, the front surface cover 310 may be rotated clockwise to be in close contact with a rear surface 27*a* of the storage bin 27 because a lower end of the front surface cover 310 may be fixed to be rotatable.

The bump 334 may be formed by protruding to interfere with a side surface of the inner cover 300. The bump 334 protrudes inward by an amount that interferes with the side surface of the front surface cover 310 of the inner cover 300. For example, since the bump 334 functions to prevent rearward movement of the front surface cover 310 of the inner cover 300, when the bump 334 may be installed not to contact with the side surface of the front surface cover 310, the function thereof may be lost.

For example, the bump 334 may protrude to overlap the side surface of the inner cover 300 by at least 0.5 mm. This configuration may aid user convenience. For example, if necessary, the user may push the inner cover 300 rearward to closely contact the rear surface of the storage bin 27 and use the entire inner space of the storage bin 27 as a storage space.

For example, when a user, especially a child, inserts a finger of the user into the gap between the raising/lowering device 200 and the inner cover 300, the front surface cover 310 may be prevented from being easily pushed rearward in order to prevent the finger from being trapped. Therefore, appropriate elasticity may be provided to prevent the front surface cover 310 from being pushed rearward.

However, when the bump 334 excessively protrudes inward and overlaps the side surface of the inner cover 300 by a size larger than 0.5 mm, the front surface cover 310 does not pass over the bump 334 when the user pushes the front surface cover 310 rearward. In another example, when the bump 334 overlaps the side surface of the inner cover 300 by a side less than 0.5 mm (equal to or less than 5 mm), the front surface cover 310 falls rearward by passing over the bump 334, even when the user grasps the raising/lowering device 200 or only touches the front surface cover 310 during operation of putting food into the storage bin 27 or taking out food in addition to the case of pushing the front surface cover 310 rearward. Therefore, there may be a safety accident or may be inconvenient to use.

A fastening end 70 may be provided in the step shape on a rear end of the storage bin 27, for example, on an upper end of the rear surface 27*a*. The fastening end 70 has at least one fastening bar 72. The fastening end 70 may be a portion where a rear end of the upper surface cover 320 of the inner cover 300 may be seated, and the fastening bar 72 may be a portion fitted into a cover fastening member 354, which will be described hereinbelow. In addition, at least one guide 80 may be provided in an upward protruding shape in rear of the fastening end 70, and guides a position where the rear end of the upper surface cover 320 may be mounted.

The front exterior material 362 and the upper exterior material 364 may be provided as separate structures. For example, the front exterior material 362 and the upper exterior material 364 may be formed separately from each other, and may be respectively installed to cover the front surface of the front surface member 340 and the upper surface of the upper surface member 350. As illustrating in the drawings, the front exterior material 362 and the upper exterior material 364 may be respectively formed in shapes corresponding to the front surface member 340 and the upper surface member 350 of the main member 330. For example, the front exterior material 362 may be formed vertically in the step shape like the front surface member 340 and the upper exterior material 364 may be formed of a flat plate having a particular width like the upper surface member 350.

In addition, the lower end of the inner cover 300 may be rotatably coupled to the bottom surface of the storage bin 27. For example, the lower end of the inner cover 300 has at least one cover hinge 348, which will be described hereinbelow, and the bottom surface in the storage bin 27 may include a hinge receiving part (or hinge receiving cavity) 27*d*, which will be described hereinbelow, to rotatably support the cover hinge 348.

In addition, the cover hinge 348 may include a support end 348*a* and a hinge shaft 348*b*, which will be described hereinbelow. The support end 348*a* may be formed by extending perpendicularly rearward from the lower end of the inner cover 300, and the hinge shaft 348*b* may be formed in a slender round bar shape at a rear end of the support end 348*a*.

Figure 18:
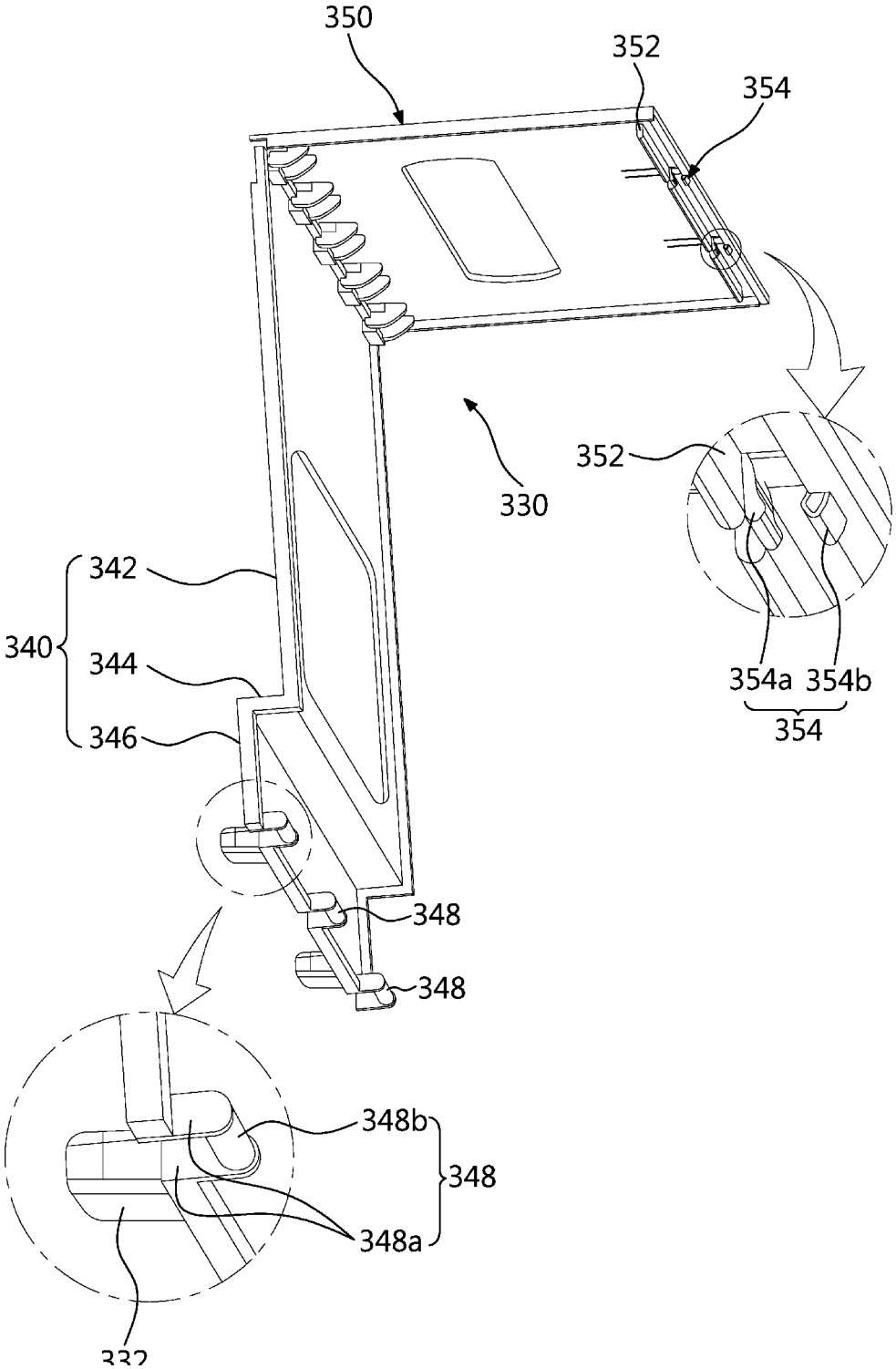
FIG. 18 is a perspective view illustrating detailed configuration of a main member according to an embodiment of the present disclosure.

Hereinbelow, configuration of the cover hinge 348 and the main member 330 will be described in detail with reference to FIG. 18. FIG. 18 may be a perspective view illustrating the main member 330. As illustrating in FIG. 18, the main member 330 may include the front surface member 340 installed vertically and the upper surface member 350 installed horizontally by being rotatably hinge-coupled to the upper end of the front surface member 340.

The front surface member 340 may be formed in the step shape like the front surface cover 310 described above, as illustrated in FIG. 18. For example, the front surface member 340 may include a main upper end portion 342, a main step surface 344, and a main lower end portion 346. The main upper end portion 342 may be provided to allow the upper surface member 350 to be rotatably connected, the main step surface 344 may be formed by being bent perpendicularly forward from a lower end of the main upper end portion 342 and extending, and the main lower end portion 346 may be formed by being bent perpendicularly downward from an end of the main step surface 344 and extending.

In addition, the locking end 332 may be formed by protruding forward from a lower end of the main lower end portion 346 of the front surface member 340, and the locking end 332 has the hook hole 332*a* described above. The main lower end portion 346 of the front surface member 340 may include the cover hinge 348 at the lower end thereof.

As illustrated in FIG. 18, the cover hinge 348 may include the support end 348*a* formed by extending perpendicularly rearward from the lower end of the front surface member 340 and the hinge shaft 348*b* formed at the rear end of the support end 348*a*. As illustrated in the drawings, the pair of support ends 348*a* may be provided, and the hinge shaft 348*b* may be connected between ends of the pair of support ends 348*a*. The hinge shaft 348*b* may be formed in the slender round bar shape, and may be mounted to the hinge receiving part 27*d*, which will be described hereinbelow.

The upper surface member 350 may be rotatably connected to the upper end of the front surface member 340. In addition, the upper surface member 350 may be configured to be rotated clockwise (e.g., in FIG. 18) in a connection state to the upper end of the front surface member 340 so as to overlap the front surface member 340.

The upper surface member 350 may have a fastening step 352 protruding downward on a rear end of a lower surface. The fastening step 352 may be seated in the fastening end 70 formed at the rear end of the storage bin 27. For example, the fastening step 352 may be seated to contact the front of the fastening end 70 formed in the step shape.

In addition, as illustrated in the drawings, the fastening step 352 may be formed in a width direction of the lower surface of the upper surface member 350, and the cover fastening member 354 may be formed in rear of the fastening step 352. The cover fastening member 354 may be provided so that the fastening bar 72 of the storage bin 27 may be inserted therein by elasticity. The cover fastening member 354 may include a moving protrusion 354*a* and a fixed protrusion 354*b*, the moving protrusion 354*a* may be formed such that a part of the fastening step 352 may be cut and the fixed protrusion 354*b* may be formed by protruding downward from the lower surface of the upper surface member 350. In some examples, the moving protrusion 354*a* may be formed such that a thickness thereof may be gradually increased from an upper end thereof to a lower end thereof and the lower end may be positioned further rearward than the upper end.

The fixed protrusion 354*b* may be formed to face the moving protrusion 354*a* at a particular distance, and may be provided such that a thickness thereof may be gradually increased from an upper end thereof to a lower end thereof and the lower end may be positioned further forward than the upper end.

Likewise, the moving protrusion 354*a* and the fixed protrusion 354*b* may be paired, and may be provided so that the fastening bar 72 may be inserted therein. For example, the moving protrusion 354*a* and the fixed protrusion 354*b* may be provided such that a distance therebetween may be gradually decreased from the upper side to the lower side, and a lower gap between the moving protrusion 354*a* and the fixed protrusion 354*b* may be formed to be smaller than an external diameter of the fastening bar 72.

For example, when the rear end of the upper surface member 350 closely contacts the rear end of the storage bin 27 from the upper side to the lower side, a lower end of the cover fastening member 354 contacts an upper end of the fastening bar 72. In this state, when the upper surface member 350 may be lowered continuously, the fastening bar 72 pushes between the moving protrusion 354*a* and the fixed protrusion 354*b* so that the moving protrusion 354*a* and the fixed protrusion 354*b* may be separated from each other by their own elasticity. Thus, the fastening bar 72 may be inserted between the moving protrusion 354*a* and the fixed protrusion 354*b* and fixed therein.

Figure 19:
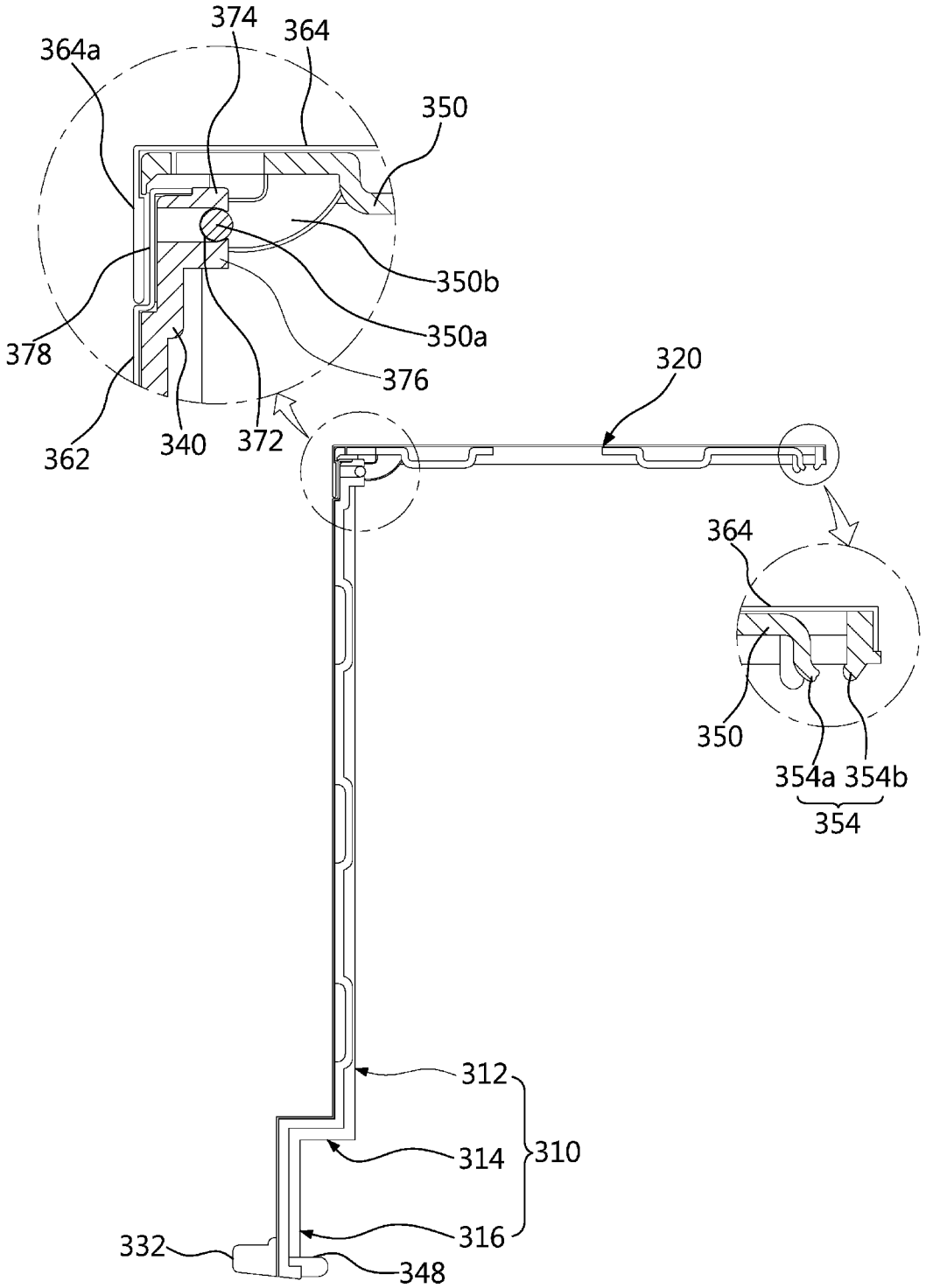
FIG. 19 is a right side sectional view illustrating the inner cover according to an embodiment of the present disclosure.
Figure 20:
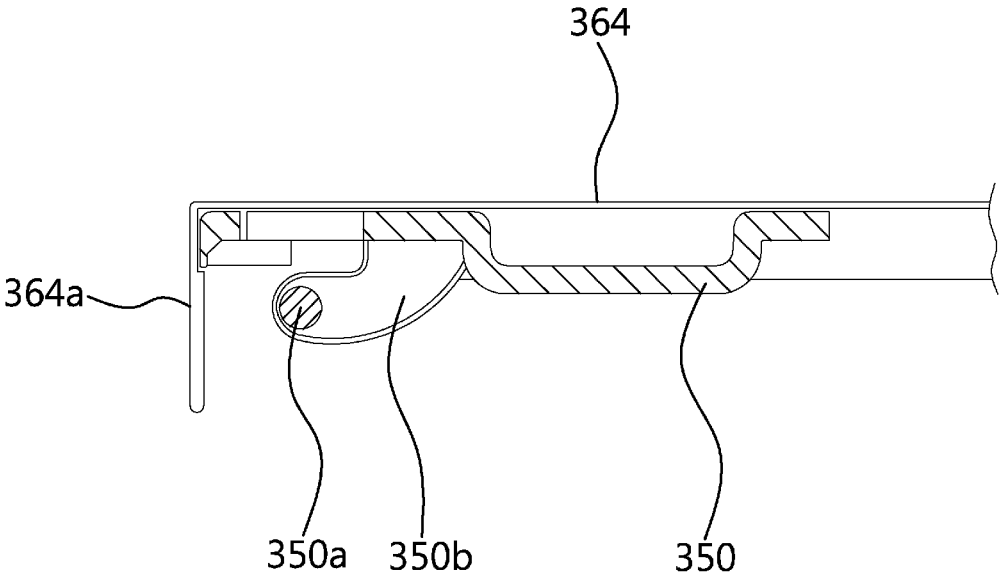
FIG. 20 is a partial sectional view illustrating a state of the inner cover separated into a front surface cover and upper surface cover according to an embodiment of the present disclosure.
Figure 20:
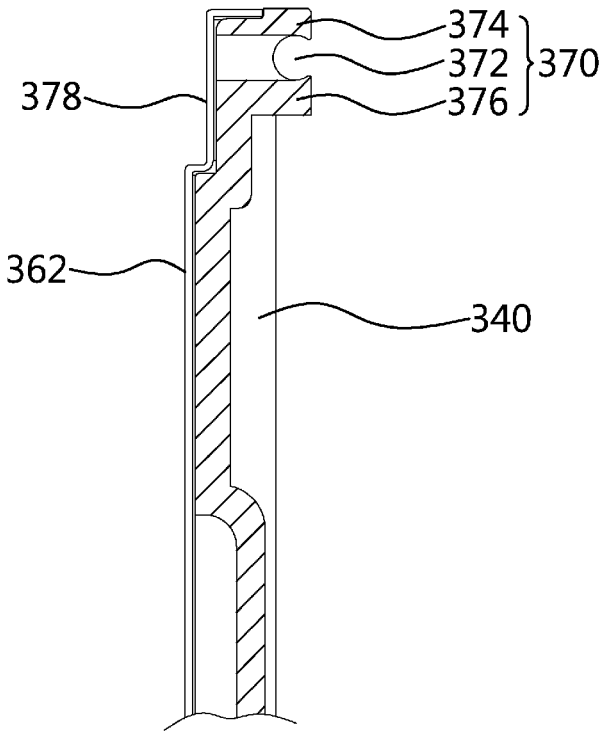
Figure 21:
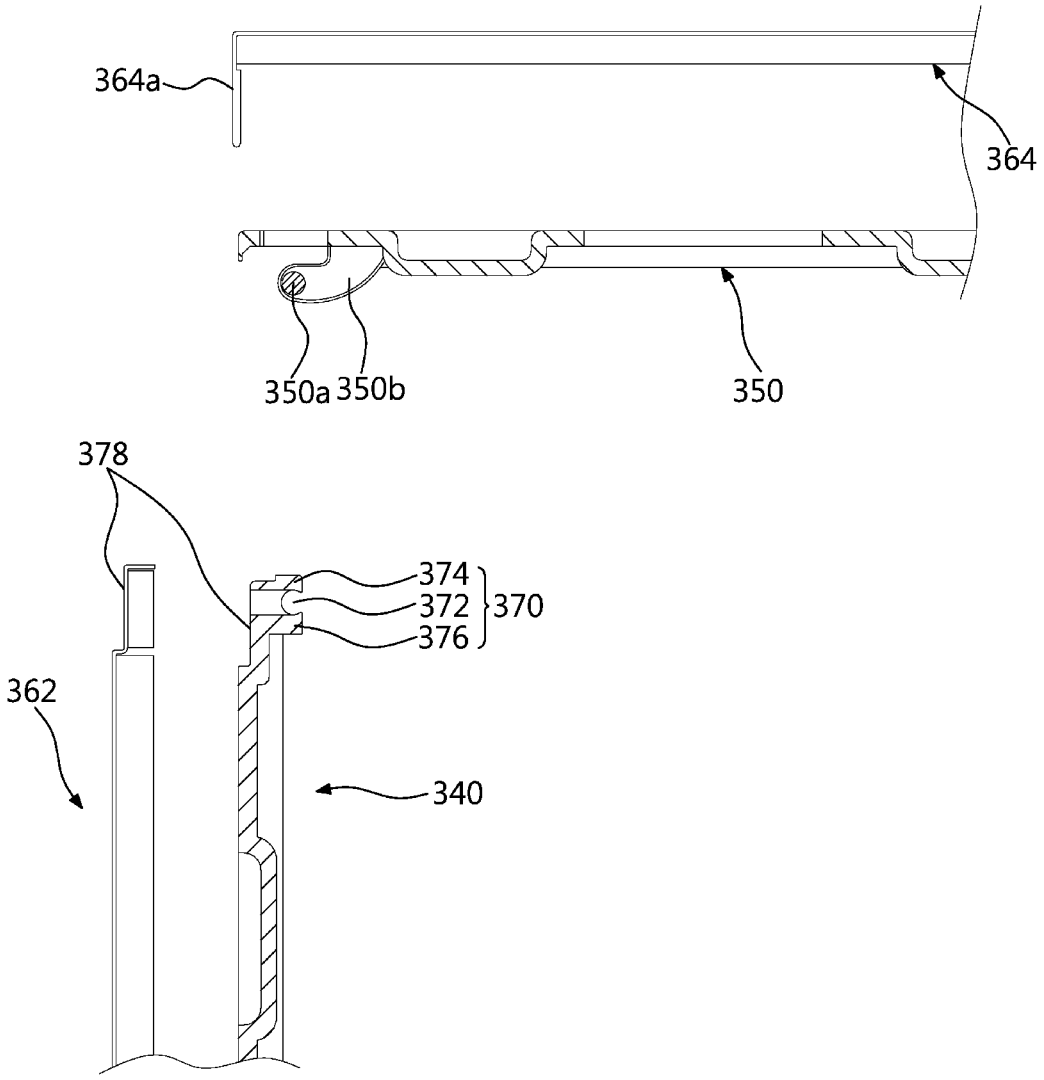
FIG. 21 is an exploded sectional view illustrating detailed configuration of each of the front surface cover and the upper surface cover according to an embodiment of the present disclosure.

FIGS. 19 to 21 may be sectional views illustrating configuration of the inner cover 300 in detail. For example, FIG. 19 may be a right side sectional view of the inner cover 300, FIG. 20 may be a sectional view illustrating a state of separating the front surface cover 310 and the upper surface cover 320 from each other, and FIG. 21 may be an exploded sectional view illustrating each of the front surface cover 310 and the upper surface cover 320.

As illustrating in the drawings, the upper surface cover 320 may be hinge-coupled to the front surface cover 310. For example, the front surface cover 310 may be configured of the front exterior material 362 and the front surface member 340, and the front surface member 340 may have a shaft fixing mechanism 370 at the upper end thereof.

The shaft fixing mechanism 370 may be rotatably fixed to the front surface member with receiving a rotation shaft 350*a*. The rotation shaft 350*a* may include a shaft groove 372 receiving the rotation shaft therein, and an upper rib 374 and the lower rib 376 that may be formed at an upper side and a lower side of the shaft groove 372.

As illustrated in the drawings, the shaft groove 372 may be formed in a semicircular shape and formed to be open rightward. As further illustrated in the drawings, the upper rib 374 and the lower rib 376 may be formed by being bent perpendicularly rightward from the upper end of the front surface member 340 and extending. In addition, right ends of the upper rib 374 and the lower rib 376 may be formed closer to each other than left ends thereof.

For example, the right ends of the upper rib 374 and the lower rib 376 may be close to each other (e.g., separated by less than a threshold distance) and formed in a concave shape. In some examples, a distance between the right ends of the upper rib 374 and the lower rib 376 may be formed to be smaller than an external diameter of the rotation shaft 350*a*, which will be described hereinbelow. For example, when the rotation shaft 350*a* may be inserted into the shaft groove 372, the rotation shaft 350*a* may be not removed rightward by elasticity of the upper rib 374 and the lower rib 376.

Upper ends of the front surface member 340 and the front exterior material 362 may be recessed rightward to form a rib groove 378. The rib groove 378 may be a part where a tip rib 364*a* of the upper exterior material 364 may be seated thereon.

As illustrated in the drawings, the upper surface cover 320 may be configured of the upper exterior material 364 and the upper surface member 350. The rotation shaft 350*a* may be formed by protruding downward on a left end of the upper surface member 350. The rotation shaft 350*a* may be formed in the slender round bar shape, may be inserted into the shaft groove 372, and may be supported by the shaft holder 350*b*. For example, a left end portion of the upper surface member 350 may position the shaft holder 350*b* to protrude downward and leftward, and the rotation shaft 350*a* may be provided on a left end portion of the shaft holder 350*b*.

For example, even when the upper surface member 350 may be rotated clockwise while the rotation shaft 350*a* may be inserted in the shaft groove 372, the upper surface member 350 and the front surface member 340 do not interfere with each other and the upper surface member 350 overlaps to a rear surface of the front surface member 340 (to a right surface in FIG. 20).

The tip rib 364*a* may be provided at an end (left end in FIG. 20) of the upper exterior material 364. The tip rib 364*a* may be formed by being bent perpendicularly downward from the end of the upper exterior material 364, and may be seated on the rib groove 378 that may be the upper front surface (left surface in FIG. 20) of the front surface cover 310.

Figure 22:
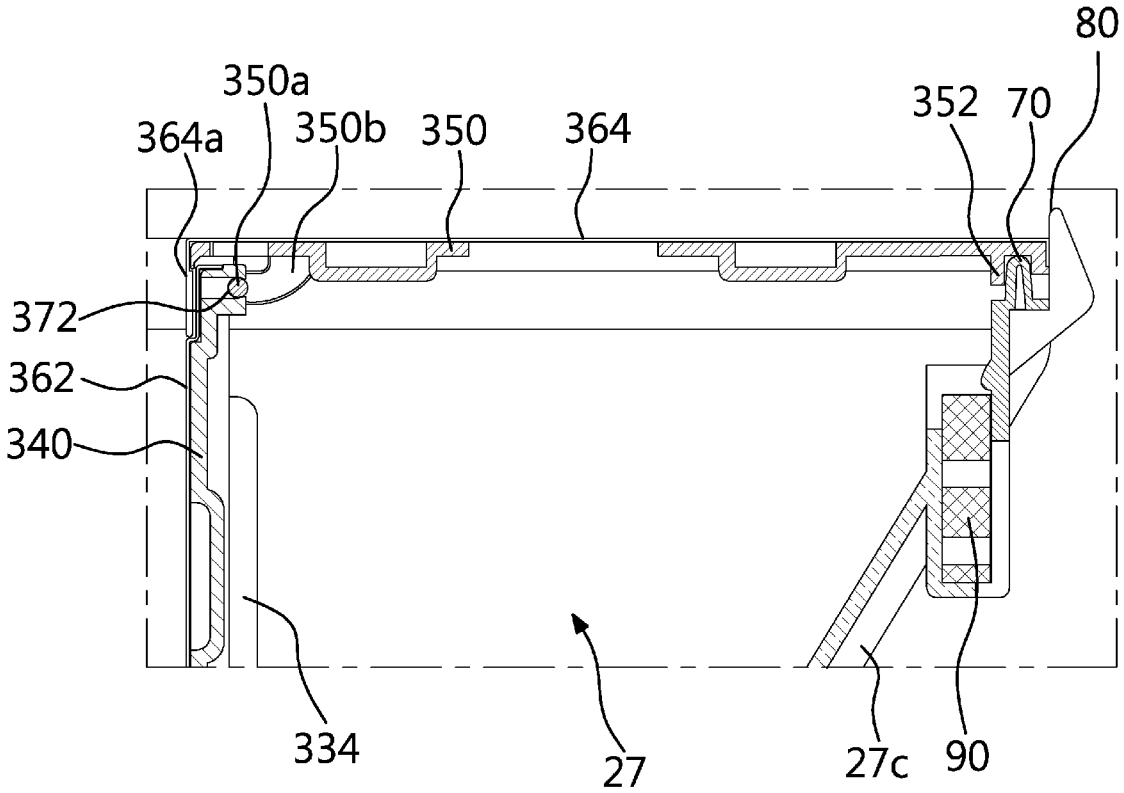
FIG. 22 is a partial sectional view illustrating a state of an upper end of the inner cover fastened to an upper end of the storage bin according to an embodiment of the present disclosure.

FIG. 22 may be a sectional view illustrating a state of an upper end portion of the inner cover 300 fastened to an upper end of the storage bin. As illustrated in FIG. 22, the rear end of the inner cover 300 may be coupled to the rear end of the storage bin 27. For example, the upper surface cover 320 may be provided to cover the upper surface of the rear end of the storage bin 27, and the rear end thereof may be fixed to the rear end of the storage bin 27 by elasticity.

In addition, the guide 80 may be provided by protruding upward on the rear end (right end in FIG. 22) of the storage bin 27. The guide 80 protrudes upward higher than the fastening end 70, and guides the rear end (right end in FIG. 22) of the upper surface cover 320 not to pass over (right side in FIG. 22) the guide 80, when the upper surface cover 320 of the inner cover 300 may be mounted (assembled) to the storage bin 27. In some examples, the rear end of the storage bin 27 may be further including a deodorizer 90, and the deodorizer 90 may be mounted to be detachable.

Figure 23:
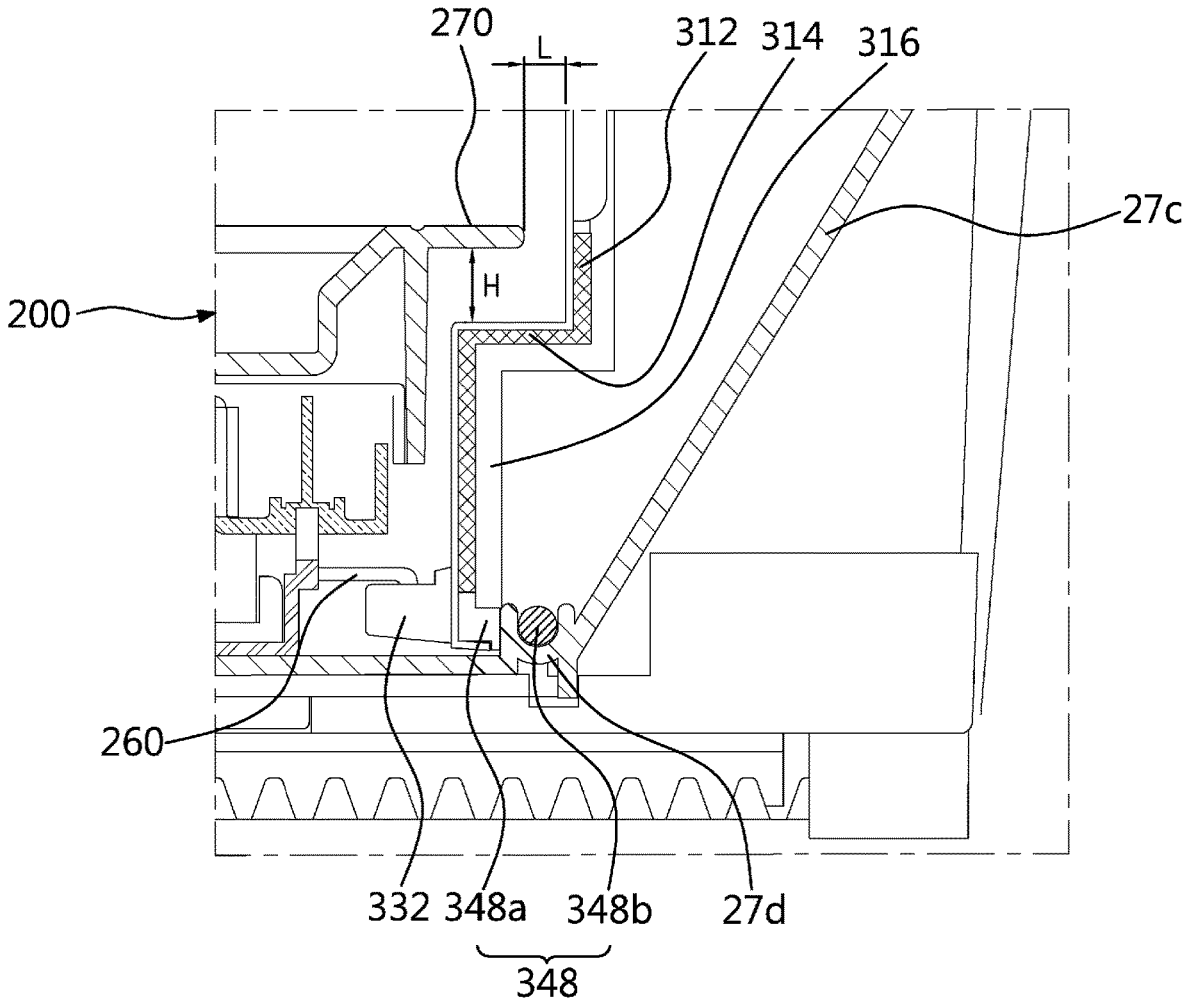
FIG. 23 is an enlarged sectional view illustrating a state of a lower end of the inner cover mounted to a bottom surface of the storage bin according to an embodiment of the present disclosure.

FIG. 23 may be an enlarged sectional view illustrating a state of the lower end of the inner cover 300 mounted to the bottom surface of the storage bin 27. As illustrated in the drawing, the raising/lowering device 200 may be placed on the bottom surface of the storage bin 27 in the folded state. As described above, the raising/lowering device 200 may be positioned at a front lower end of the inner cover 300. For example, on the bottom surface of the storage bin 27, the raising/lowering device 200 for raising and lowering the container 40 may be installed, and the raising/lowering device 200 may be positioned in front of the front surface cover 310 of the inner cover 300.

Between the raising/lowering device 200 and the inner cover 300, a covering mechanism may be provided. For example, since the raising/lowering device 200 may be installed to be removable by being lifted upward, as described above, a gap may be formed between the rear end of the raising/lowering device 200 and the inner cover 300. For example, a user's finger may be inserted into the gap. For example, there may be a safety risk associated with a child's finger being trapped in the gap. Thus. the covering mechanism may at least partially cover the gap between the raising/lowering device 200 and the inner cover 300, and the cover piece 270 may be used as the covering mechanism.

As described above, on the upper end of the raising/lowering device 200, the support plate 210 may be provided to have the shape corresponding to the shape of the lower end of the container 40 so as to support the lower end thereof. The cover piece 270 may be provided at the rear end of the support plate 210.

As described above, the cover piece 270 may be formed by extending rearward from the rear end of the raising/lowering device 200 at a particular length. Specifically, the cover piece 270 may be formed of a flat plate having a particular thickness, and may be formed by extending rearward from the rear end of the support plate 210 of the raising/lowering device 200 at a particular length.

In some examples, a gap L between the cover piece 270 and the inner cover 300 may be formed less than 6 mm considering a thickness of a user's finger. For example, usually, a thickness of a person's finger may be greater than 6 mm, so that the gap L may be formed with a width of 6 mm to prevent the person's finger from being inserted therein.

In addition, as illustrated in the drawings, the cover piece 270 and the step surface 314 may be installed to overlap each other up and down. For example, the cover piece 270 may be positioned above the step surface 314 that may be provided in the front surface cover 310 of the inner cover 300, and the step surface 314 and the cover piece 270 may be provided to overlap each other.

When the cover piece 270 and the step surface 314 overlap up and down, even when the finger of a user may be inserted from the upper side into the gap L between the cover piece 270 and the inner cover 300, the step surface 314 prevents the insertion of the finger. In addition, a height between the cover piece 270 and the step surface 314 may be formed higher than 10 mm for protecting a child's finger.

For example, even when the gap L between the cover piece 270 and the inner cover 300 may be formed less than 6 mm, the child's finger may be inserted into the gap L and lowered downward. Even in this case, it may be possible that a child's finger may be trapped between the cover piece 270 and the step surface 314.

For example, since the raising/lowering device 200 may be seated downward due to its own weight, when the height H between the cover piece 270 and the step surface 314 may be formed less than 10 mm, a child's finger may be pressed between the cover piece 270 and the step surface 314, thereby causing a safety accident. The height H of 10 mm or more may be to prevent the safety accident.

In addition, the lower end of the inner cover 300 may be rotatably coupled to the bottom surface of the storage bin 27. For example, as described above, at least one cover hinge 348 may be provided at the lower end of the inner cover 300, and the hinge receiving part **27*d* rotatably supporting the cover hinge 348 may be provided at the bottom surface in the storage bin 27**.

The hinge receiving part **27*d* may be provided to be open upward at the rear end of the bottom surface of the storage bin 27. For example, as illustrated in the drawing, the hinge receiving part 27*d* may be formed to have a semicircular inner section and supports the hinge shaft 348*b*** to be removable upward and mountable from above.

Figure 24:
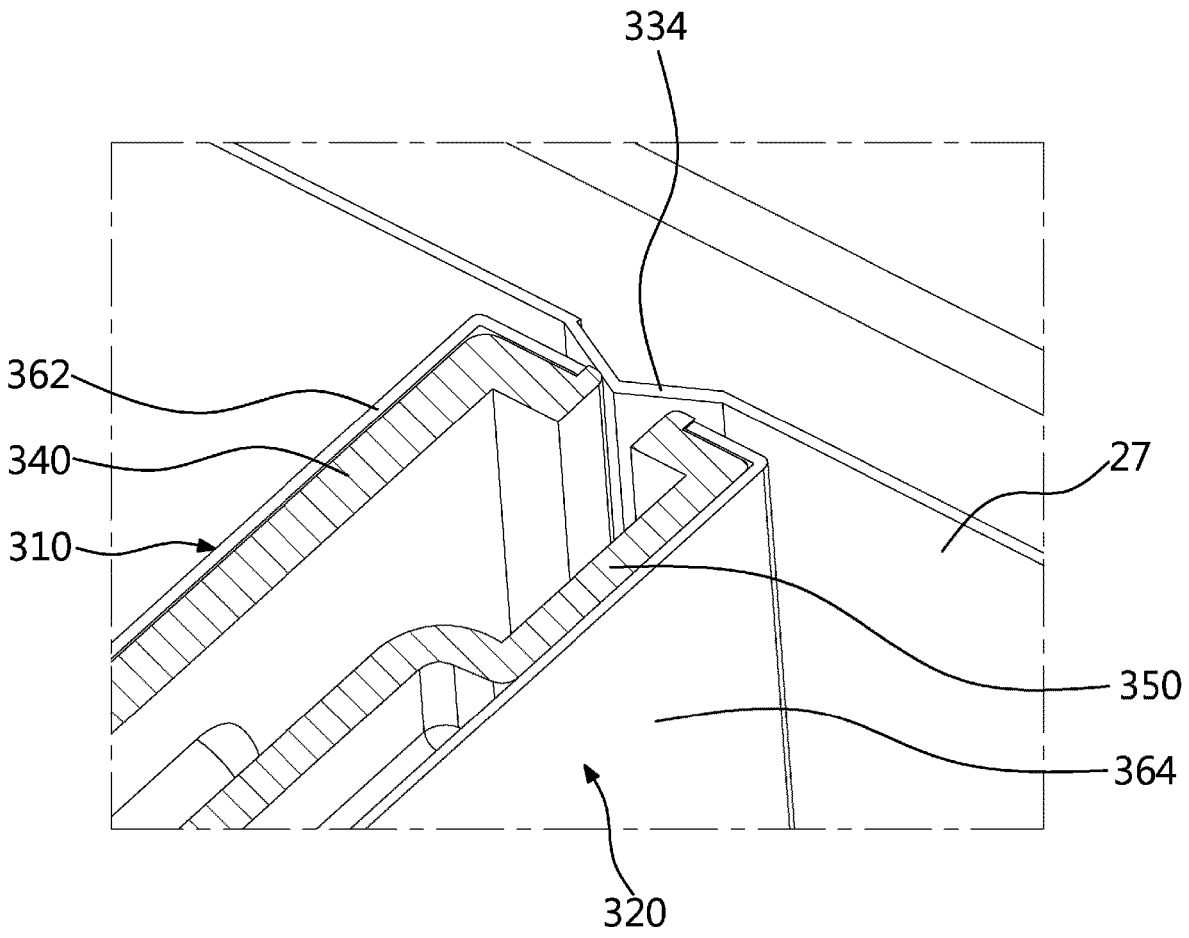
FIG. 24 is a partial cut sectional view illustrating an installation state of each of the front surface cover and a bump according to an embodiment of the present disclosure.

FIG. 24 may be a partial cut sectional view illustrating an installation state of each of the front surface cover 310 and the bump 334. For example, the drawing illustrates a partial cut perspective view in which the upper surface cover 320 may be rotated on the rotation shaft **350*a* so that the front surface cover 310, and the upper surface cover 320 may be overlap and the bump 334 prevents the rearward movement of the front surface cover 310**.

As illustrated in FIG. 24, the front surface cover 310 may be installed to be positioned in front of the bump 334 (left side in FIG. 24), and may be prevented to be moved rearward (right side in FIG. 24). For example, the bump 334 prevents the rearward movement of the front surface cover 310 by elasticity. For example, illustrated in the drawing, the bump 334 may be formed by protruding inward to interfere with the side surface of the inner cover 300. For example, the bump 334 protrudes inward from the inside surface of the storage bin 27 to interfere with the side surface of the inner cover 300.

In addition, the bump 334 may be integrally formed with the inner surface of the storage bin 27 or may be provided as a separate structure to be attached to the inner surface of the storage bin 27. The bump 334 may be formed by protruding to overlap the side surface of the inner cover 300 by at least 0.5 mm. For example, as described above, when the inner cover 300 may be pushed over a particular force, the inner cover 300 may be movable past the bump 334.

Aspects of the present disclosure provide a refrigerator, wherein a peripheral gap of a raising/lowering device may be blocked. In addition, aspects of the present disclosure relate to a refrigerator, wherein a finger of a user may be prevented from being inserted into the gap between the raising/lowering device and an inner cover of the storage bin. In addition, aspects of the present disclosure provide a refrigerator, wherein even when a child's finger may be inserted into the peripheral gap of the raising/lowering device, a safety accident such as trapping and crushing of the finger may be prevented.

Thus, according to one aspect of the present disclosure, there may be provided a refrigerator that may include a cabinet having a storage chamber therein, a cooling device provided to cool the storage chamber, a drawer including a storage bin in which a container or food may be stored, a raising/lowering device provided to raise/lower a container storing food, and a covering mechanism provided to cover a peripheral gap of the raising/lowering device.

In addition, the refrigerator may include a cabinet having a storage chamber therein, a cooling device provided to cool the storage chamber, a drawer including a storage bin in which a container or food may be stored, a raising/lowering device provided to raise/lower a container storing food, an inner cover provided to cover a rear end portion of an inner space of the storage bin, and a covering mechanism provided to cover a peripheral gap of the raising/lowering device.

In addition, the refrigerator may include a cabinet having a storage chamber therein, a cooling device provided to cool the storage chamber, a drawer including a storage bin in which a container or food may be stored, a raising/lowering device provided to raise/lower a container storing food, an inner cover provided to cover a rear end portion of an inner space of the storage bin, wherein a cover piece may be provided by extending rearward at a rear end of the raising/lowering device so that a gap between the raising/lowering device and the inner cover may be formed less than a particular size.

In addition, the refrigerator may include a cabinet having a storage chamber therein, a cooling device provided to cool the storage chamber, a drawer including a storage bin in which a container or food may be stored, a raising/lowering device provided to raise/lower a container storing food, and an inner cover provided to cover a rear end portion of an inner space of the storage bin, wherein a cover piece may be provided by extending rearward at a rear end of the raising/lowering device and a front surface of the inner cover may be formed in a step shape, so that the cover piece and a step surface of the inner cover may be configured to overlap up and down.

In addition, the refrigerator may include a cabinet having a storage chamber therein, a cooling device provided to cool the storage chamber, a drawer including a storage bin in which a container or food may be stored, a raising/lowering device provided to raise/lower a container storing food, an inner cover provided to cover a rear end portion of an inner space of the storage bin, and a bump provided at a side surface in the storage bin and preventing rearward movement of the inner cover.

In addition, the refrigerator may include a cabinet having a storage chamber therein and an open front; a cooling device provided at one side of the cabinet and cooling the storage chamber; a drawer including a front panel and a storage bin, the front panel being pulled out and pushed in so that an open front portion of the storage chamber may be opened and closed and the storage bin being provided in rear of the front panel and storing a container or food therein; an inner cover provided at the storage bin so as to cover a rear end portion of an inner space of the storage bin; a raising/lowering device provided in front of the inner cover of the storage bin, and configured to fold downward and unfold upward so as to move a container upward and downward in which food may be stored; and a covering mechanism provided to cover a gap between the raising/lowering device and the inner cover.

The covering mechanism may include a cover piece that may be formed by extending rearward from a rear end of the raising/lowering device. In addition, a gap between the cover piece and the inner cover may be formed less than 6 mm. On an upper end of the raising/lowering device, a support plate may be provided to have a shape corresponding to a shape of a lower end of the container so as to support the lower end of the container, and the cover piece may be provided at a rear end of the support plate.

The inner cover may include: a front surface cover partitioning the inner space of the storage bin into a front space and a rear space and formed in a step shape; and an upper surface cover rotatably connected to an upper end of the front surface cover, and covering a rear upper surface of the front surface cover.

The front surface cover may include an upper end portion at an upper end thereof for rotatable connection of the upper surface cover, a step surface formed by being bent perpendicularly forward from a lower end of the upper end portion and extending, and a lower end portion formed by being bent perpendicularly downward from an end of the step surface and extending.

In addition, the cover piece and the step surface may be provided to overlap up and down. A height between the cover piece and the step surface may be formed higher than 10 mm. A bump may be provided at a side surface in the storage bin to prevent rearward movement of the inner cover. The bump may be formed to have elasticity. The bump may protrude to interfere with a side surface of the inner cover. In addition, the bump may protrude to overlap the side surface of the inner cover by at least 0.5 mm.

A lower end of the inner cover may be rotatably connected to a bottom surface of the storage bin. In addition, the lower end of the inner cover may include at least one cover hinge, and a bottom surface in the storage bin may include a hinge receiving part for rotatably supporting the cover hinge.

The cover hinge may include: a support end formed by extending perpendicularly rearward from the lower end of the inner cover; and a hinge shaft provided at a rear end of the support end and formed in a slender round bar. The hinge receiving part may be open upward and formed to have a semicircular inner section, and support the hinge shaft to be removable upward or mountable from above.

The inner cover may include: a main member formed by injection molding and forming a frame of the inner cover; and an exterior material coupled to a front surface and an upper surface of the main member to form an exterior of the inner cover. The exterior material may be formed of a metal material or a clad material.

The main member may include: a front surface member provided vertically inside the storage bin; and an upper surface member that may be rotatably connected to an upper end of the front surface member and covers a rear upper portion of the front surface member.

The exterior material may include: a front exterior material provided in close contact with a front surface of the front surface member; and an upper exterior material provided in close contact with an upper surface of the front surface member, wherein each of the front exterior material and the upper exterior material may be formed in a separate structure. A rear end of the inner cover may be coupled to a rear end of the upper surface of the storage bin.

According to the refrigerator of the present disclosure, the inner cover may be provided in the storage bin of the storage chamber to partition the inside of the storage bin into a front space and a rear space, and the raising/lowering device may be provided in front of the inner cover to move the container upward and downward. In addition, the covering mechanism may be provided between the inner cover and the raising/lowering device to cover the gap between the inner cover and the raising/lowering device. For example, a safety accident such as a finger of a user being trapped in the peripheral gap of a raising/lowering device can be efficiently prevented.

In addition, according to the present disclosure, the cover piece may be formed by extending rearward at the rear end of the upper surface of the raising/lowering device, and the gap between the cover piece and the inner cover may be maintained less than 6 mm. For example, it may be possible to prevent a finger of a user from being inserted into the gap between the inner cover and the raising/lowering device, when the raising/lowering device may be folded and unfolded up and down.

In addition, according to the present disclosure, while the cover piece may be provided at the rear end of the raising/lowering device as described above, the front cover forming the front surface of the inner cover may be formed in the step shape. In addition, the step surface of the front cover and the cover piece may be installed to partially overlap up and down. For example, even when a user's finger passes through the gap between the inner cover and the cover piece and enters downward, the step surface of the front cover prevents the finger from further entering downward so that a safety accident can be prevented.

Furthermore, according to the present disclosure, while the step surface of the front cover and the cover piece may be provided to overlap up and down, and the height between the cover piece and the step surface may be maintained higher than 10 mm. For example, even when a child's finger passes through the gap between the inner cover and the cover piece and enters downward, the finger can be prevented from being trapped and crushed between the step surface and the cover piece.

Meanwhile, according to the present disclosure, the bump may be provided at the side surface in the storage bin to prevent the rearward movement of the inner cover. For example, even when the user's finger or the child's finger may be inserted into the gap between the inner cover and the raising/lowering device, the inner cover may be not pushed rearward so that the safety accident can be prevented.

Although the present invention has been described for illustrative purposes, those skilled in the art will appreciate that various modifications, additions and substitutions are possible, without departing from the scope and spirit of the invention as disclosed in the accompanying claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

This application is also related to U.S. application Ser. No. 16/583,726 filed Sep. 26, 2019, U.S. application Ser. No. 16/582,518 filed Sep. 25, 2019, U.S. application Ser. No. 16/582,605 filed Sep. 25, 2019, U.S. application Ser. No. 16/582,712 filed Sep. 25, 2019, U.S. application Ser. No. 16/582,756 filed Sep. 25, 2019, U.S. application Ser. No. 16/582,810 filed Sep. 25, 2019, U.S. application Ser. No. 16/582,668 filed Sep. 25, 2019, U.S. application Ser. No. 16/582,755 filed Sep. 25, 2019, U.S. application Ser. No. 16/582,831 filed Sep. 25, 2019, U.S. application Ser. No. 16/585,284 filed Sep. 27, 2019, U.S. application Ser. No. 16/585,301 filed Sep. 27, 2019, and U.S. application Ser. No. 16/585,816 filed Sep. 27, 2019, whose entire disclosures are also hereby incorporated by reference.

What is claimed is:

1. A refrigerator, comprising:

a cabinet having a storage chamber provided therein and an opening to access the storage chamber;

a drawer including a front panel and a storage bin provided at the rear of the front panel to receive a container, the drawer being slidably coupled to the cabinet such that drawer moves between a first position in which the front panel closes the opening of cabinet and the bin is positioned in the storage chamber, and a second position in which the front panel is spaced away from the opening of the cabinet and at least a portion of the storage bin is positioned outside of the storage chamber;

an first cover provided at the storage bin so as to cover a rear end of an inner space of the storage bin;

a lift module provided in front of the first cover of the storage bin, and including arms that are configured to fold downward and unfold upward so as to move the container upward and downward; and a second cover provided to cover a gap between the lift module and the first cover, wherein the second cover includes a cover ledge that is positioned to extend rearward from a rear end of the lift module.

2. The refrigerator of claim 1, wherein a gap between the cover ledge and the first cover is formed to be less than 6 mm.

3. The refrigerator of claim 1, wherein a support plate is provided on an upper end of the lift module to have a shape corresponding to a shape of a lower end of the container so as to support the lower end of the container, and the cover ledge is provided at a rear edge of the support plate.

4. The refrigerator of claim 1, wherein the first cover includes:

a front surface cover partitioning the first space of the storage bin into a front space and a rear space, the front surface cover including a step surface formed by being bent in a step shape;

wherein the cover ledge and the step surface partially overlap vertically so as to cover a part of the step surface.

5. The refrigerator of claim 4, wherein the first cover includes:

an upper surface cover rotatably connected to an upper end of the front surface cover and covering a rear upper surface of the front surface cover.

6. The refrigerator of claim 4, wherein a height between the cover ledge and the step surface is formed to be higher than 10 mm.

7. The refrigerator of claim 1, further comprising:

a bump at a side surface in the storage bin, the bump contacting the first cover so as to prevent a rearward movement of the first cover.

8. The refrigerator of claim 7, wherein the bump is formed of an elastic material.

9. The refrigerator of claim 8, wherein the bump protrudes to interfere with a side surface of the first cover.

10. The refrigerator of claim 9, wherein the bump protrudes to overlap the side surface of the first cover by at least 0.5 mm.

11. The refrigerator of claim 1, wherein a lower end of the first cover is rotatably connected to a bottom surface of the storage bin.

12. The refrigerator of claim 11, wherein the lower end of the first cover includes at least one cover hinge, and a bottom surface in the storage bin include includes a hinge receiving cavity to receive a portion of the cover hinge.

13. The refrigerator of claim 12, wherein the cover hinge includes:

a support end the extends rearward from the lower end of the first cover; and a hinge shaft provided at a rear end of the support end.

14. The refrigerator of claim 13, wherein the hinge receiving cavity is open upward, is formed to have a semicircular inner section, and supports the hinge shaft such that the hinge shaft is removable upward or mountable from above.

15. The refrigerator of claim 1, wherein the first cover comprises:

a frame that is formed by injection molding; and an exterior cladding coupled to a front surface and an upper surface of the frame to form an exterior of the first cover.

16. The refrigerator of claim 15, wherein the exterior cladding is formed of a metal or a combination of metals.

17. The refrigerator of claim 15, wherein the frame includes a front surface wall provided vertically inside the storage bin, and an upper surface wall that is rotatably connected to an upper end of the front surface wall and is positioned to cover a rear upper portion of the front surface wall.

18. The refrigerator of claim 17, wherein the exterior cladding includes a front exterior cladding provided at a front surface of the front surface wall and an upper exterior cladding provided at an upper surface of the front surface wall, and the front exterior cladding and the upper exterior cladding are formed as separate structures.

19. A refrigerator, comprising:

a cabinet having a storage chamber provided therein and an opening to access the storage chamber;

a drawer including a front panel and a storage bin provided at the rear of the front panel to receive a container, the drawer being slidably coupled to the cabinet such that drawer moves between a first position in which the front panel closes the opening of cabinet and the bin is positioned in the storage chamber, and a second position in which the front panel is spaced away from the opening of the cabinet and at least a portion of the storage bin is positioned outside of the storage chamber;

an first cover provided at the storage bin so as to cover a rear end of an inner space of the storage bin;

a lift module provided in front of the first cover of the storage bin, and including arms that are configured to fold downward and unfold upward so as to move the container upward and downward;

a second cover provided to cover a gap between the lift module and the first cover; and a bump at a side surface in the storage bin, the bump contacting the first cover so as to prevent a rearward movement of the first cover.

20. A refrigerator, comprising:

a cabinet having a storage chamber provided therein and an opening to access the storage chamber;

a drawer including a front panel and a storage bin provided at the rear of the front panel to receive a container, the drawer being slidably coupled to the cabinet such that drawer moves between a first position in which the front panel closes the opening of cabinet and the bin is positioned in the storage chamber, and a second position in which the front panel is spaced away from the opening of the cabinet and at least a portion of the storage bin is positioned outside of the storage chamber;

an first cover provided at the storage bin so as to cover a rear end of an inner space of the storage bin;

a lift module provided in front of the first cover of the storage bin, and including arms that are configured to fold downward and unfold upward so as to move the container upward and downward; and a second cover provided to cover a gap between the lift module and the first cover, wherein a lower end of the first cover is rotatably connected to a bottom surface of the storage bin.

* * * * *